US009791195B2

(12) United States Patent
Okada et al.

(10) Patent No.: US 9,791,195 B2
(45) Date of Patent: Oct. 17, 2017

(54) COOLING DEVICE MANAGEMENT SYSTEM WITH REFRIGERANT LEAKAGE DETECTION FUNCTION

(71) Applicant: DAIKIN INDUSTRIES, LTD., Osaka-shi, Osaka (JP)

(72) Inventors: Ryouhei Okada, Sakai (JP); Shouichi Hasuike, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 329 days.

(21) Appl. No.: 14/405,135

(22) PCT Filed: May 15, 2013

(86) PCT No.: PCT/JP2013/063545

§ 371 (c)(1),
(2) Date: Dec. 2, 2014

(87) PCT Pub. No.: WO2013/183414

PCT Pub. Date: Dec. 12, 2013

(65) Prior Publication Data

US 2015/0159931 A1 Jun. 11, 2015

(30) Foreign Application Priority Data

Jun. 4, 2012 (JP) ..... 2012-127270

(51) Int. Cl.
*F25B 49/00* (2006.01)
*F25B 45/00* (2006.01)
*F24F 11/00* (2006.01)

(52) U.S. Cl.
CPC ..... *F25B 49/00* (2013.01); *F24F 11/008* (2013.01); *F24F 11/0086* (2013.01);
(Continued)

(58) Field of Classification Search
CPC ..... F25B 2500/22; F25B 2500/222; F24F 2011/0068; F24F 2011/0084
(Continued)

(56) References Cited

U.S. PATENT DOCUMENTS 6,279,332 B1 8/2001 Yeo et al.
2003/0074905 A1* 4/2003 Taira ..... B60H 1/3217 62/114
(Continued)

FOREIGN PATENT DOCUMENTS

EP 1 257 038 A1 11/2002
EP 1 970 651 A1 9/2008
(Continued)

OTHER PUBLICATIONS

International Search Report of corresponding PCT Application No. PCT/JP2013/063545 dated Aug. 20, 2013.
(Continued)

*Primary Examiner* — Dominick L Plakkoottam
*Assistant Examiner* — Daniel C Comings
(74) *Attorney, Agent, or Firm* — Global IP Counselors, LLP

(57) ABSTRACT

A cooling device management system is connected to a cooling device that carries out refrigerant leakage detection mode to detect leaks of refrigerant. The cooling management system includes a transmission section that transmits instructions to the cooling device, a reception section that receives information from the cooling device, a refrigerant leakage detection schedule setting section that receives inputting of settings of a refrigerant leakage detection schedule in order to carry out the refrigerant leakage detection mode in the cooling device, a schedule executing section, and a display section. The schedule executing section transmits instructions to carry out the refrigerant leakage detection mode from the transmission section to the cooling device based on the refrigerant leakage detection schedule which is received using the refrigerant leakage detection schedule setting section. The display section outputs results
(Continued)

of the refrigerant leakage detection mode based on the information received from the cooling device.

18 Claims, 13 Drawing Sheets

(52) U.S. Cl.
CPC ..... *F25B 49/005* (2013.01); *F24F 2011/0073* (2013.01); *F24F 2011/0084* (2013.01); *F24F 2011/0091* (2013.01); *F25B 2500/22* (2013.01); *F25B 2500/222* (2013.01)

(58) Field of Classification Search
USPC ..... 62/127, 149
See application file for complete search history.

(56) References Cited

U.S. PATENT DOCUMENTS

| | | | |
|---|---|---|---|
| 2008/0209926 | A1 | 9/2008 | Matsuoka et al. |
| 2009/0126379 | A1 | 5/2009 | Yamaguchi et al. |

FOREIGN PATENT DOCUMENTS

| | | | |
|---|---|---|---|
| JP | 2001-115963 | A | 4/2001 |
| JP | 2002-81725 | A | 3/2002 |
| JP | 2004-85043 | A | 3/2004 |
| JP | 2004-301480 | A | 10/2004 |
| JP | 2007-163099 | A | 6/2007 |
| JP | 2010-7997 | A | 1/2010 |
| KR | 10-2010-0069403 | A | 6/2010 |
| WO | 01/49515 | A1 | 7/2001 |
| WO | 2005/121664 | A1 | 12/2005 |
| WO | 2007/022779 | A1 | 3/2007 |
| WO | 2007/114180 | A1 | 10/2007 |
| WO | 2008/035418 | A1 | 3/2008 |

OTHER PUBLICATIONS

International Preliminary Report of corresponding PCT Application No. PCT/JP2013/063545 dated Dec. 9, 2014.
European Search Report of corresponding EP Application No. 13 80 0693.7 dated May 12, 2015.

* cited by examiner

| OUTDOOR UNIT 1 | | OUTDOOR UNIT 2 | | OUTDOOR UNIT 3 | |
|---|---|---|---|---|---|
| DATE AND TIME | COOLANT LEAKAGE AMOUNT | DATE AND TIME | COOLANT LEAKAGE AMOUNT | DATE AND TIME | COOLANT LEAKAGE AMOUNT |
| 2010/11/10 AM2:00 | x1 | 2010/11/10 AM2:00 | x2 | 2010/11/10 AM2:00 | x3 |
| 2010/5/10 AM1:00 | xa | 2010/5/10 AM1:00 | xb | 2010/5/10 AM1:00 | xc |
| ⋮ | ⋮ | ⋮ | ⋮ | ⋮ | ⋮ |

FIG. 7

COOLING DEVICE MANAGEMENT SYSTEM WITH REFRIGERANT LEAKAGE DETECTION FUNCTION

CROSS-REFERENCE TO RELATED APPLICATIONS

This U.S. National stage application claims priority under 35 U.S.C. §119(a) to Japanese Patent Application No. 2012-127270, filed in Japan on Jun. 4, 2012, the entire contents of which are hereby incorporated by reference.

TECHNICAL FIELD

The present invention relates to a cooling device management system and in particular to a cooling device management system with a refrigerant leakage detection function.

BACKGROUND ART

Cooling devices are being used in recent years with a refrigerant leakage detection function which was developed with the object of taking precautions against reductions in performance or malfunctions due to leaking of refrigerant. For example, an air conditioning device which is a cooling device which is disclosed in Japanese Laid-Open Patent Application Publication No. 2007-163099 has a function of the refrigerant leakage detection driving to periodically detect whether or not refrigerant is leaking from a refrigerant circuit to the outside. In the refrigerant leakage detection driving, the amount of refrigerant (current amount) currently in the refrigerant circuit is calculated from the amounts in various types of driving states, and the presence or absence of refrigerant leaks is determined by comparing the current amount with a reference amount of refrigerant (initial amount) which is loaded in the initial arrangement of the air conditioning device and which is stored.

SUMMARY

Technical Problem

Here, the refrigerant leakage detection driving described above is performed to target, for example, time periods where air conditioning is unnecessary such as on holidays or late at night. In detail, in order to execute the refrigerant leakage detection driving with the cooling device, a refrigerant leakage detection driving mode is selected and executed using an operation panel or an operation button which is attached to the cooling device by a maintenance worker travelling to the location where the cooling device is disposed. When the refrigerant leakage detection driving is completed, for example, LEDs which are arranged on a print substrate in the cooling device flash to show the presence or absence of refrigerant leaks and the amount of refrigerant leakage.

However, along with an increase in the number of cooling devices for which the refrigerant leakage detection driving is necessary, there is a large cost in sending out maintenance workers to each location.

The object of the present invention is to provide a cooling device management system which reduces costs which are necessary for refrigerant leakage detection driving.

Solution to Problem

A cooling device management system according to a first aspect of the present invention is connected to a cooling device and is provided with a transmission section, a reception section, a refrigerant leakage detection schedule setting section, a schedule executing section, and a display section. The cooling device has a function of carrying out refrigerant leakage detection driving. The refrigerant leakage detection driving is driving for detecting leaks of refrigerant in a refrigerant circuit to the outside. The transmission section transmits instructions to the cooling device. The reception section receives information from the cooling device. The refrigerant leakage detection schedule setting section receives inputting of settings for a refrigerant leakage detection schedule. The refrigerant leakage detection schedule is a schedule for carrying out the refrigerant leakage detection driving in the cooling device. The schedule executing section transmits instructions to carry out the refrigerant leakage detection driving from the transmission section to the cooling device based on the refrigerant leakage detection schedule which is received using the refrigerant leakage detection schedule setting section. The display section outputs the results of the refrigerant leakage detection driving which is based on information which is received from the cooling device.

In this cooling device management system, it is possible to set the refrigerant leakage detection schedule for carrying out the refrigerant leakage detection driving. The instructions to carry out the refrigerant leakage detection driving are transmitted to the cooling device based on the refrigerant leakage detection schedule. In addition, information is received from the cooling device and the results of the refrigerant leakage detection driving are output based on the information which is received. Thereby, it is possible to execute the refrigerant leakage detection driving in the cooling device and to confirm the results of this at a location which is separated from the location where the cooling device is disposed. Accordingly, it is possible to reduce costs which are necessary for the refrigerant leakage detection driving.

A cooling device management system according to a second aspect of the present invention is the cooling device management system according to the first aspect of the present invention where a controller and a remote monitoring device are provided. The controller performs controlling of the cooling device and is arranged in the vicinity of the cooling device. The remote monitoring device is arranged at a distance from the cooling device and performs controlling of the cooling device through the controller. The controller has the transmission section, the reception section, the refrigerant leakage detection schedule setting section, the schedule executing section, and the display section.

In this cooling device management system, the controller has the transmission section, the reception section, the refrigerant leakage detection schedule setting section, the schedule executing section, and the display section, and the refrigerant leakage detection driving is executed based on a schedule which is set using the controller. Thereby, it is possible to perform detecting of refrigerant leaks at one time with regard to a plurality of air conditioning devices at a building where the air conditioning devices are disposed.

A cooling device management system according to a third aspect of the present invention is the cooling device management system according to the first aspect or the second aspect of the present invention where the schedule executing section transmits instructions, which are for performing a specific display which accompanies the refrigerant leakage detection driving on the display section, from the transmission section to the cooling device in addition to the instructions to carry out the refrigerant leakage detection driving.

In this cooling device management system, when the refrigerant leakage detection driving is carried out in the cooling device, the specific display is performed on a display unit in the cooling device. Thereby, it is possible to notify users of the cooling device that the cooling device is carrying out the refrigerant leakage detection driving.

A cooling device management system according to a fourth aspect of the present invention is the cooling device management system according to any of the first aspect to the third aspect of the present invention where the schedule executing section transmits instructions, which are so that an operation inputting section of the cooling device does not receive inputting of specific operations during the refrigerant leakage detection driving, from the transmission section to the cooling device in addition to the instructions to carry out the refrigerant leakage detection driving.

In this cooling device management system, inputting of the specific operations is not received in the cooling device when the refrigerant leakage detection driving is being carried out in the cooling device. The specific operations are, for example, an operation of turning the power off, an operation of stopping driving, an operation of changing the driving mode, and the like. Thereby, it is possible to acquire accurate detection results since it is possible to execute the refrigerant leakage detection driving without being impeded by other operations.

A cooling device management system according to a fifth aspect of the present invention is the cooling device management system according to any of the first aspect to the fourth aspect of the present invention where the schedule executing section does not transmit the instructions to carry out the refrigerant leakage detection driving when it is determined that it is an inappropriate state, where it is not appropriate to carry out the refrigerant leakage detection driving in the cooling device, from state information which relates to the state of the unit of the cooling device which is received by the receiving section.

In this cooling device management system, it is determined whether or not the cooling device is in a state where it is possible to execute the refrigerant leakage detection driving before the instructions to carry out the refrigerant leakage detection driving is transmitted. That is, the refrigerant leakage detection driving is not performed in a case where accurate detection results will not be acquired. Thereby, it is possible to improve the reliability of the detection result.

A cooling device management system according to a sixth aspect of the present invention is the cooling device management system according to any of the first aspect to the fifth aspect of the present invention where a normal schedule setting section is further provided. The normal schedule setting section receives inputting of settings for a normal schedule. The normal schedule includes at least a schedule for starting driving and stopping driving for a specific unit of the cooling device. The schedule executing section prioritizes the refrigerant leakage detection schedule over the normal schedule.

In this cooling device management system, the refrigerant leakage detection schedule is executed by being prioritized over the normal schedule. Thereby, it is possible to execute the refrigerant leakage detection driving as planned.

A cooling device management system according to a seventh aspect of the present invention is the cooling device management system according to the sixth aspect of the present invention where the schedule executing section restarts driving of the cooling device which is based on the normal schedule after the refrigerant leakage detection driving is completed in the cooling device in a case where driving of the cooling device which is based on the normal schedule is cancelled in order to carry out the refrigerant leakage detection driving which is based on the refrigerant leakage detection schedule in the cooling device.

In this cooling device management system, driving of the cooling device which is based on the normal schedule is restarted after the refrigerant leakage detection driving is completed in a case where driving of the cooling device which is based on the normal schedule is cancelled in order to carry out the refrigerant leakage detection driving which is based on the refrigerant leakage detection schedule in the cooling device. Thereby, it is possible to automatically restart the normal schedule which is interrupted in order to execute the refrigerant leakage detection driving.

A cooling device management system according to an eighth aspect of the present invention is the cooling device management system according to any of the first aspect to the seventh aspect of the present invention where the cooling device is provided with a refrigerant circuit in which flows a simple R32 refrigerant.

In this cooling device management system, a simple R32 refrigerant flows in the refrigerant circuit of the cooling device. Thereby, it is possible to reliably discover refrigerant leaks in the cooling device which uses a simple R32 refrigerant.

Advantageous Effects of Invention

In the cooling device management system according to the first aspect of the present invention, it is possible to reduce costs which are necessary for the refrigerant leakage detection driving.

In the cooling device management system according to the second aspect of the present invention, it is possible to perform detecting of refrigerant leaks at one time with regard to a plurality of air conditioning devices at the building where the air conditioning devices are disposed.

In the cooling device management system according to the third aspect of the present invention, it is possible to notify users of the cooling device that the cooling device is carrying out the refrigerant leakage detection driving.

In the cooling device management system according to the fourth aspect of the present invention, it is possible to acquire accurate detection results since it is possible to execute the refrigerant leakage detection driving without being impeded by other operations.

In the cooling device management system according to the fifth aspect of the present invention, it is possible to improve the reliability of the detection result.

In the cooling device management system according to the sixth aspect of the present invention, it is possible to execute the refrigerant leakage detection driving as planned.

In the cooling device management system according to the seventh aspect of the present invention, it is possible to automatically restart the normal schedule which is interrupted in order to execute the refrigerant leakage detection driving.

In the cooling device management system according to the eighth aspect of the present invention, it is possible to reliably discover refrigerant leaks in the cooling device which uses a simple R32 refrigerant.

BRIEF DESCRIPTION OF THE DRAWINGS

FIG. 7 is a diagram illustrating a refrigerant leakage detection result which is acquired after refrigerant leakage detection driving.

DESCRIPTION OF EMBODIMENTS

A cooling device management system 100 according to an embodiment of the present invention is described below with reference to the drawings.

(1) Overall Configuration of Cooling Device Management System

Figure 1:
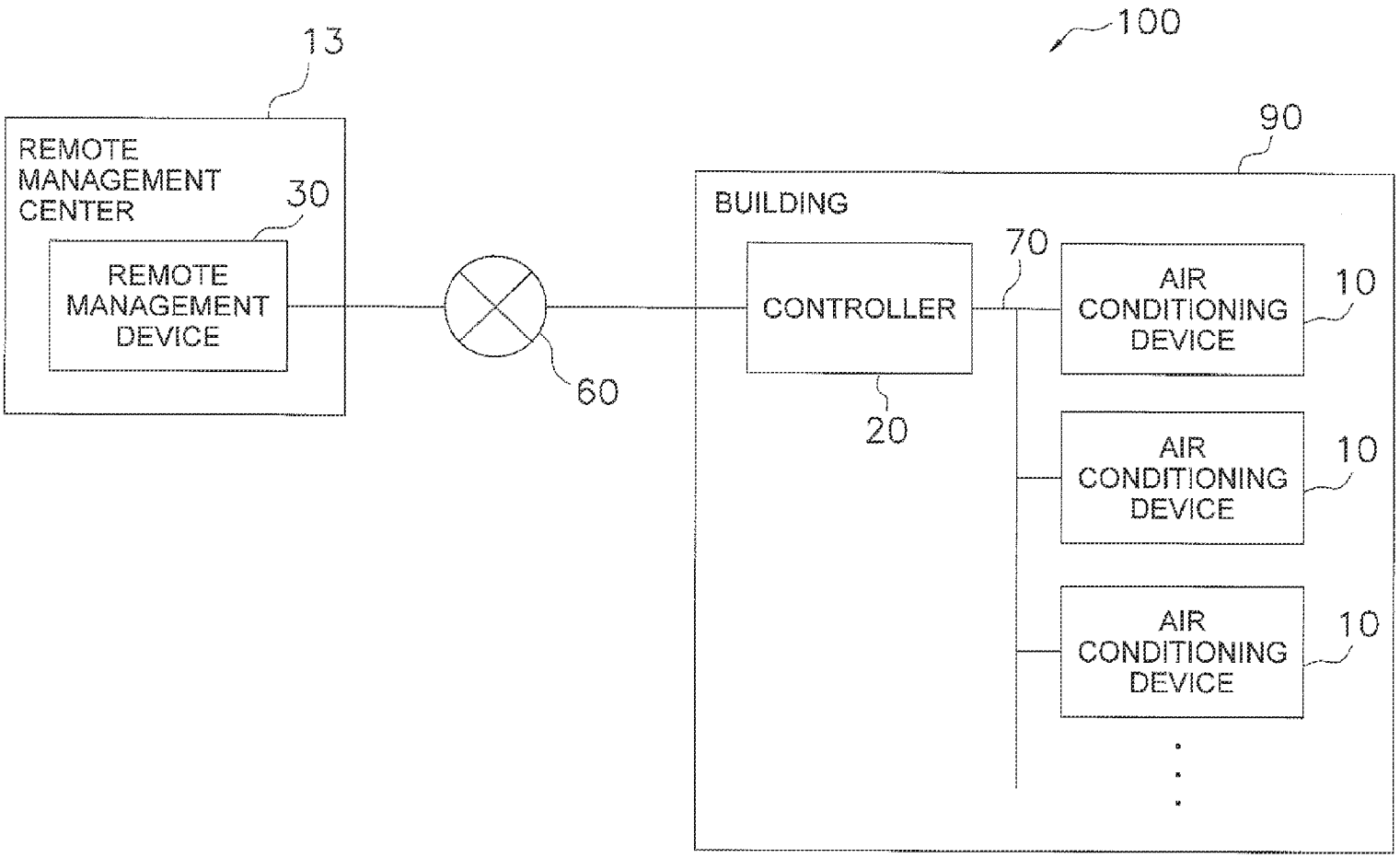
FIG. 1 is a diagram illustrating a configuration of a cooling device management system according to an embodiment of the present invention.

The cooling device management system 100 which is shown in FIG. 1 is a system for managing an air conditioning device 10 which is a cooling device which is disposed in a building 90. The cooling device management system 100 is a system which monitors and controls the air conditioning device 10 at a location which is separate from the location where the air conditioning device 10 is disposed. In addition, the cooling device management system 100 is a system for detecting the presence or absence of refrigerant leaks in the air conditioning device 10 at a location which is separate from the location where the air conditioning device 10 is disposed.

The cooling device management system 100 is mainly configured from the air conditioning device 10, a controller 20, and a remote management device 30. Each of the air conditioning devices 10 includes one unit of an outdoor unit 11 and a plurality of indoor units 12. In the present embodiment, a plurality of the air conditioning devices 10 are disposed in the building 90. The controller 20 has a function of monitoring and controlling the air conditioning devices 10. The controller 20 is disposed in a management personnel room or the like in the building 90. The plurality of the air conditioning devices 10 are connected to the controller 20. The controller 20 and the air conditioning devices 10 are connected using dedicated wiring 70. The controller 20 controls a plurality of the outdoor units 11 and the plurality of the indoor units 12 which are connected to each of the outdoor units 11. The remote management device 30 is a server which is provided in a remote management center 13 which is positioned at a distance from the building 90. The remote management device 30 is able to connect with the controller 20 through an Internet 60.

In the cooling device management system 100, instructions (detection control instructions) for executing a refrigerant leakage detection driving mode is transmitted from either of the controller 20 or the remote management device 30, which are disposed at locations which are separated from the outdoor units 11, with regard to the air conditioning devices 10. The refrigerant leakage detection driving mode is a driving mode for detecting the presence or absence of refrigerant leaks. In the refrigerant leakage detection driving mode, all of the indoor units 12 which are connected to the outdoor units 11 which are the targets are compulsorily driven in a mode for cooling for a specific period of time (for example, 110 minutes). In the refrigerant leakage detection driving mode, the state of the refrigerant which circulates in a refrigerant circuit is stabilized and the amount of refrigerant in the refrigerant circuit is calculated as described in Japanese Unexamined Patent Application Publication No. 2007-163099, WO2007/069578, EP1970652A1, and the like by compulsorily driving to cool for a specific period of time Each of the configurations which are included in the cooling device management system 100 will be described below.

(2) Air Conditioning Device

Figure 2:
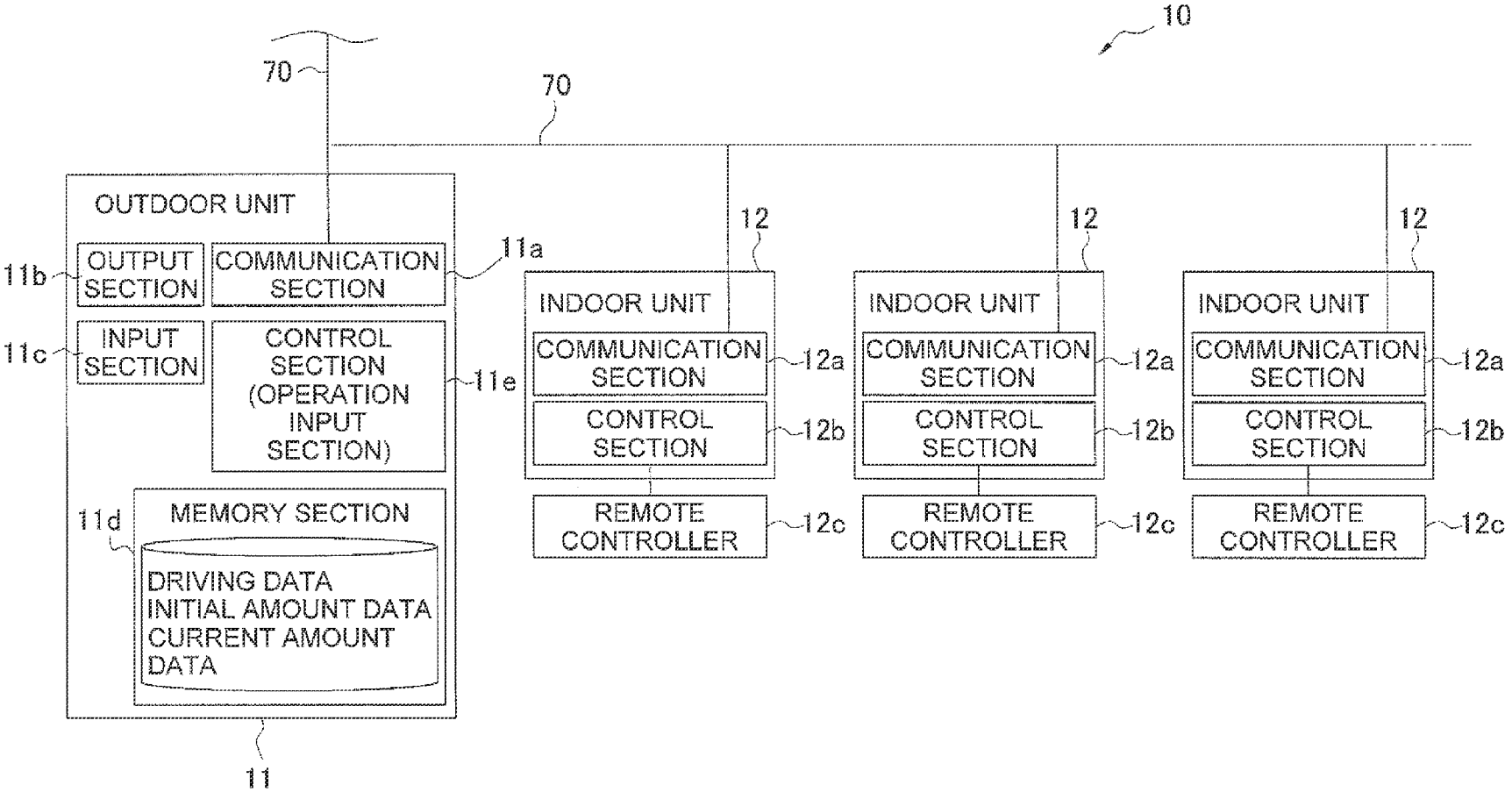
FIG. 2 is a diagram illustrating a configuration of an air conditioning device.

As shown in FIG. 2, the air conditioning device 10 includes one unit of the outdoor unit 11 and the plurality of indoor units 12. It is possible for a maximum of 64 units of the indoor units 12 to be connected with one unit of the outdoor unit 11. That is, one of the refrigerant circuits are configured from one unit of the outdoor unit 11 and a maximum of 64 units of the indoor units 12. The air conditioning device 10 has an overall configuration as the refrigerant circuit which is configured from a compressor, a heat exchanger, and the like which are not shown in the diagrams. Simple R32 refrigerant flows in the refrigerant circuit in the air conditioning device 10 according to the present embodiment. The outdoor unit 11 and the indoor units 12 are connected using the dedicated wiring 70 and refrigerant piping. As shown in FIG. 2, a remote controller 12*c* which receives inputting of operations with regard to each of the indoor units 12 is separately attached to the air conditioning device 10. The remote controller 12*c* has an input section and a display section. The input section receives control instructions with regard to each of the indoor units 12. The display section displays the driving situation of each of the indoor units 12. Information on performing driving in either of driving for cooling, driving for heating, undergoing inspection, or refrigerant leakage detection driving and information such as the settings for temperature, the amount of air flow, and the air flow direction are included as the driving situation which is displayed on the display section of the remote controller 12*c*. That is, the remote controller 12*c* also functions as a display section for the air conditioning device 10 which displays each type of information on the air conditioning device 10. Here, the input section invalidates input which is related to specific operations until cancelation instructions are received after restriction instructions which will be described later are received from the controller 20. Here, the specific operations are, for example, an operation of turning the power off, an operation of stopping driving, an operation of changing the driving mode, and the like.

(2-1) Indoor Unit

The indoor unit 12 mainly has the communication section 12*a* and the control section 12*b*. The communication section 12*a* is an interface for performing communication with the outdoor unit 11. The control section 12*b* receives a control signal from the outdoor unit 11 through the communication section 12*a* and each section which configures the indoor unit 12 is run based on the control signal. In addition, the control section 12*b* sends data which relates to the driving state (the state of on or off, the suction temperature, and the like) with regard to the outdoor unit 11 through the control section 12*a*.

(2-2) Outdoor Unit

The outdoor unit 11 mainly has a communication section 11*a*, an output section 11*b*, an input section 11*c*, a memory section 11*d*, and a control section (an operation input section) 11*e*.

(2-2-1) Communication Section

The communication section 11*a* is an interface for performing communication with the indoor units 12 as described above. In addition, the communication section 11*a* is an interface for performing communication with the controller 20.

(2-2-2) Output Section

The output section 11*b* is a plurality of LEDs which flash or are turned off. The LEDs are provided on a print substrate which is not shown in the diagrams. The output section 11*b* expresses the state of the air conditioning device 10 by flashing and turning off the plurality of LEDs. Here, the state of the air conditioning device 10 which is indicated by the output section 11*b* is the presence or absence of abnormalities being generated in the outdoor unit 11, the type of abnormalities which are generated, the presence or absence of refrigerant leaks, and the like. That is, the output section 11*b* changes the way in which the LED flash or are turned off according to the state of the air conditioning device 10.

(2-2-3) Input Section

The input section 11*c* is a button for receiving instructions for executing the refrigerant leakage detection driving from a maintenance worker. In other words, the output section 11*c* is a button which is directly operated by a maintenance worker travelling to the location where the air conditioning device 10 is disposed. The button is provided on the casing of the outdoor unit 11 which is not shown in the diagrams. The refrigerant leakage detection driving is executed by the control section 11*e* when instructions for executing the refrigerant leakage detection driving are received using the input section 11*c*.

(2-2-4) Memory Section

The memory section 11*d* is mainly configured from a ROM, a RAM, and a hard disk. Programs which are able to be executed by being read out by the control section 11*e* which will be described later are stored in the memory section 11*d*. In addition, driving data, initial amount data, and current amount data are stored in the memory section 11*d* as shown in FIG. 2.

Driving data for the outdoor unit 11 and driving data for the indoor units 12 are included in the driving data. The driving data for the outdoor unit 11 has the meaning of values for the state of the various types of components which are included in the outdoor unit 11, and the outdoor temperature and outdoor humidity which are detected by the outdoor unit 11. The values for the state of the various types of components which are included in the outdoor unit 11 are, for example, the frequency of the compressor, the number of rotations of an outdoor fan, and the temperature and pressure of the refrigerant at specific positions in the refrigerant circuit. Parameters for driving the indoor units 12, the indoor temperature, the indoor humidity, and values for the state of the various types of components which are included in the indoor unit 12 are included in the driving data for the indoor units 12. The parameters for driving the indoor unit 12 are, for example, the state of starting or stopping the indoor units 12, the settings for temperature, the settings for humidity, the settings for air flow, the settings for direction of air flow, and the driving modes such as cooling, heating, ventilating, dehumidifying, and the like. In addition, the values for the state of the various types of components which are included in the indoor unit 12 are, for example, the number of rotations of an indoor fan and the temperature and pressure of the refrigerant at specific positions in the refrigerant circuit. In addition, data where it is possible to identify whether the air conditioning device 10 is in any of the states of driving, undergoing inspection, or emergency shutdown and data where it is possible to identify normal or abnormal with regard to the air conditioning device 10 are included in the driving data.

The initial amount data is data which relates to the amount of refrigerant which is filled using automatic driving for filling refrigerant which is carried out in the initial arrangement of the air conditioning device 10 and is data which relates to the amount of refrigerant which is filled into the refrigerant circuit according to the configuration of the air conditioning device 10 at the initial arrangement of the air conditioning device 10. The initial amount data is the amount of refrigerant which is a reference (reference amount of refrigerant). The initial amount data is stored in the memory section 11*d* as initial amount data along with the date and time of when the first automatic driving for filling refrigerant is carried out.

The current amount data is data which relates to the amount of refrigerant which is filled into the refrigerant circuit at the current point in time. The current amount data is data which is acquired by carrying out the refrigerant leakage detection driving. The current amount data is the latest data which relates to the amount of refrigerant which is acquired by executing the latest refrigerant leakage detection driving. The current amount data is stored in the memory section 11*d* as current amount data along with the date and time of when the refrigerant leakage detection driving is carried out after the refrigerant leakage detection driving is carried out.

In addition, information which relates to errors which are generated during executing of the refrigerant leakage detection driving may be included in the memory section 11*d*.

(2-2-5) Control Section

The control section 11*e* is mainly configured from a CPU. The control section 11*e* reads out and executes programs which are stored in the memory section 11*d*. The control section 11*e* functions as an operation inputting section. The operation inputting section receives various types of control instructions which are sent from the controller 20. The control section 11*e* runs the air conditioning device 10 (that is, the outdoor unit 11 and the indoor units 12) based on control instructions which are received using the operation inputting section. Here, the operation inputting section invalidates input which is related to specific operations until cancelation instructions are received after restriction instructions which will be described later are received from the controller 20. The specific operations are, for example, an operation of turning the power off, an operation of stopping driving, an operation of changing the driving mode, and the like in the same manner as the content described above.

In addition, the control section 11*e* runs each of the sections which configures the outdoor unit 11 according to control instructions (the state of starting or stopping the indoor units 12, the settings for temperature, the settings for humidity, the settings for air flow, the settings for direction of air flow, and the driving mode) which are sent from the controller 20. In detail, the control section 11*e* generates control instructions for performing adjusting of the frequency of the compressor, the number of rotations of a fan, the opening of various valve, and the like.

Furthermore, the control section 11*e* acquires the driving data from the indoor units 12 according to control instructions which are sent from the controller 20 and transmits the driving data on the indoor units 12 which is acquired to the controller 20. In addition, the control section 11*e* acquires the driving data on the outdoor unit 11 from the memory section 11*d* and transmits the driving data on the outdoor units 11 which is acquired to the controller 20 according to control instructions which are sent from the controller 20.

Furthermore, the control section 11*e* executes the refrigerant leakage detection driving based on control instructions which are received using the input section 11*c* or control instructions (detection control instructions) which is sent from the controller 20. That is, driving for cooling is compulsorily carried out with regard to all of the indoor units 12 which configure the same refrigerant system of the outdoor unit 11, the state of the refrigerant which circulates in the refrigerant circuit is stabilized, and the amount of refrigerant in the refrigerant circuit is calculated. The control section 11*e* stores the current amount of refrigerant which is acquired using this calculation (the current amount), the date and time when the refrigerant leakage detection driving is executed, errors which are generated in the refrigerant leakage detection driving, and the like in the memory section 11*d*.

(3) Controller

Figure 3:
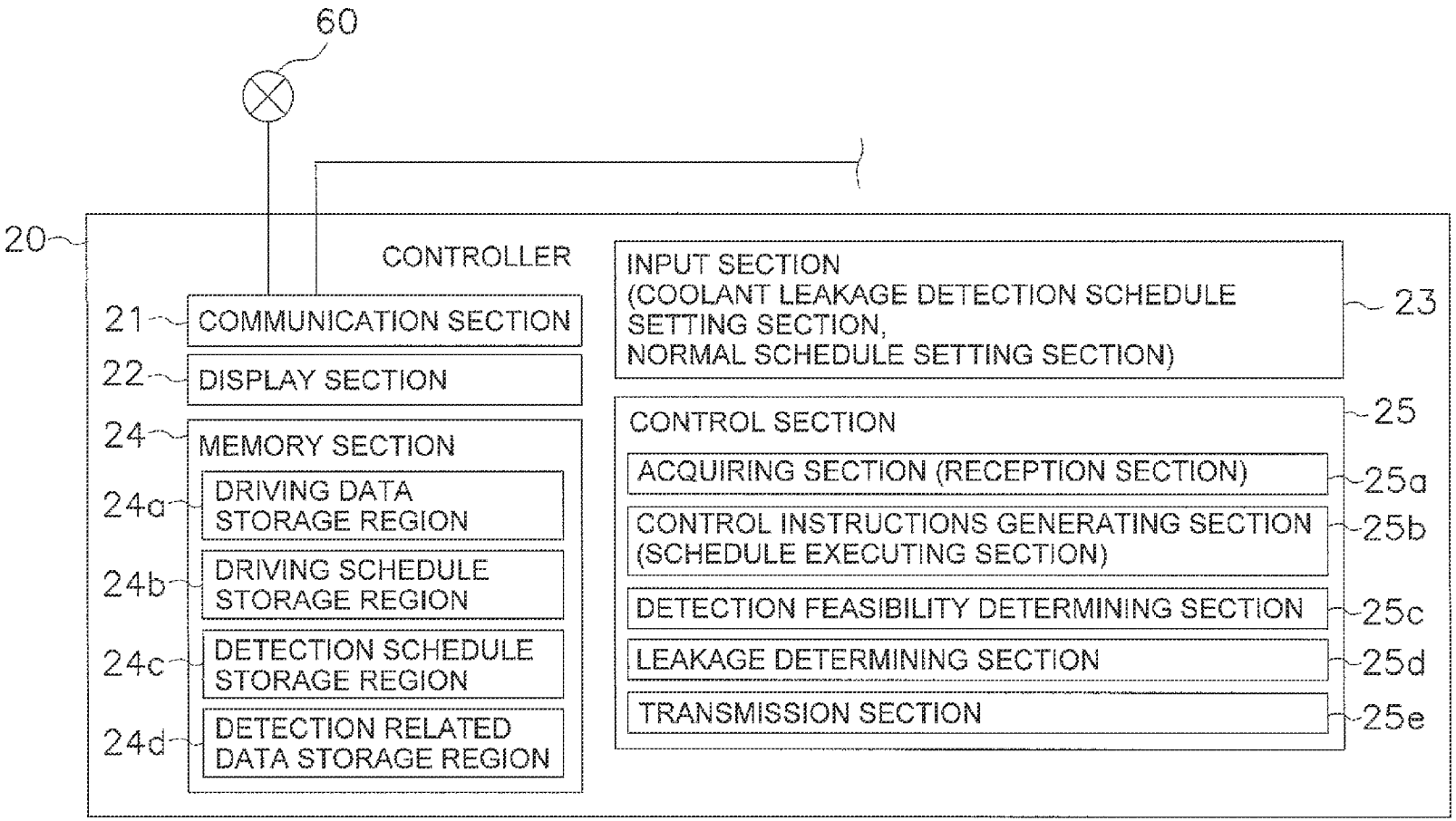
FIG. 3 is a diagram illustrating a configuration of a controller.

Next, the controller 20 will be described next with reference to FIG. 3. The controller 20 has a function of monitoring and controlling the air conditioning device 10 as described above. The controller 20 is mainly configured from a communication section 21, a display section 22, an input section (a refrigerant leakage detection schedule setting section and a normal schedule setting section) 23, a memory section 24, and a control section 25.

(3-1) Communication Section

The communication section 21 is an interface where it is possible for the controller 20 to connect with the Internet 60 and the air conditioning device 10.

(3-2) Display Section and Input Section

The display section 22 is mainly configured from a display.

The input section 23 receives various types of settings with regard to the controller 20. The input section 23 is configured from a touch panel which covers the display.

Figure 4:
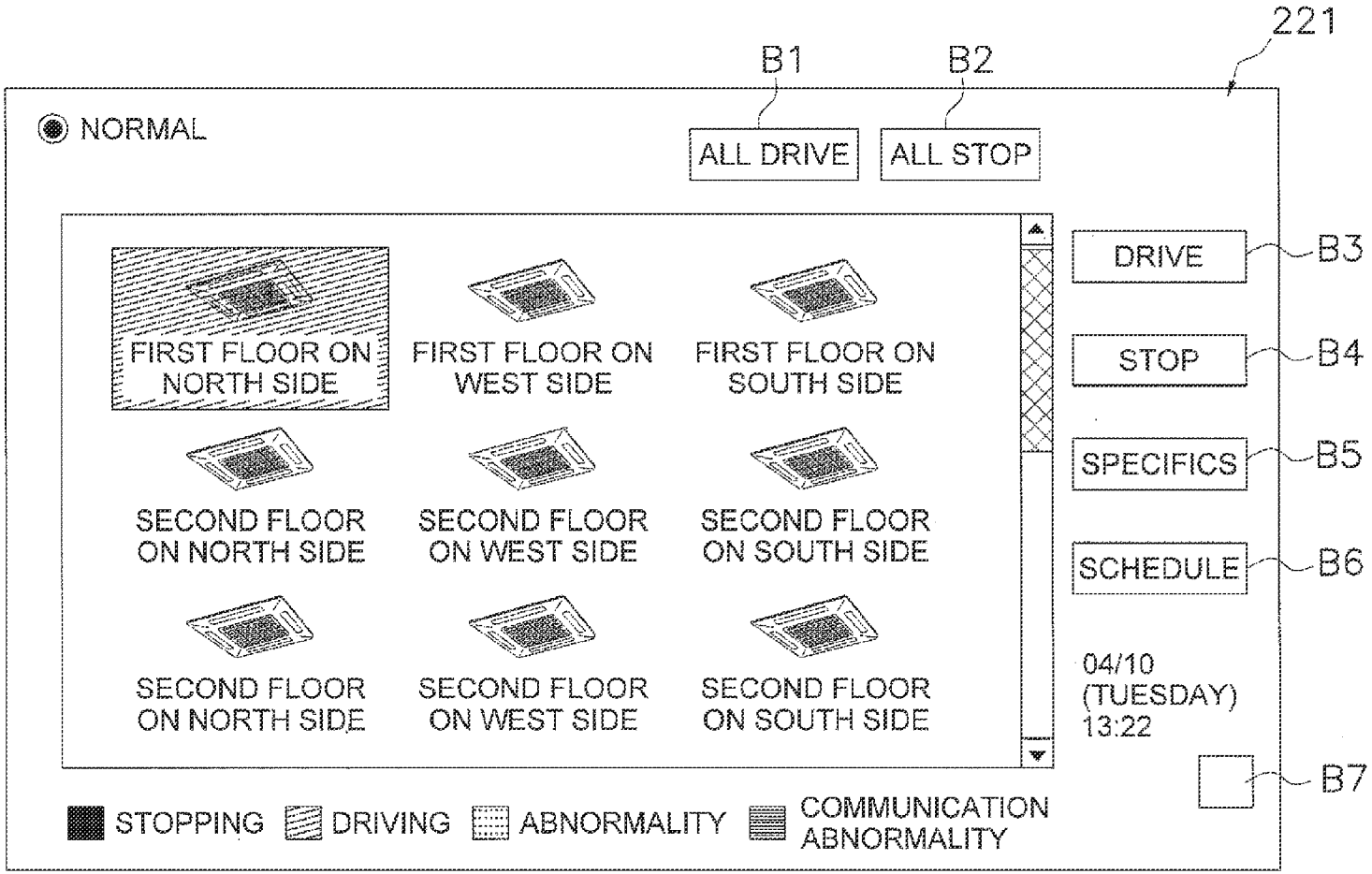
FIG. 4 is a diagram illustrating a management screen which is shown on a display section of a controller.

The display section 22 displays a management screen 221 for the air conditioning device 10 which is mainly used by a user (refer to FIG. 4), screens 222 and 223 which relate to the refrigerant leakage detection driving and which are mainly used by a maintenance worker (refer to FIG. 5 and FIG. 6), and detection results of the refrigerant leakage detection driving (refer to FIG. 7).

Driving information for each of the indoor units 12 is displayed in the management screen 221. For example, states such as stopping, driving, abnormality, communication abnormality, and the like are included in the driving information which is displayed on the management screen 221. The driving information is stored in the memory section 24 which will be described later.

Furthermore, various types of buttons B1 to B7 for performing control of each of the indoor units 11 are provided in the management screen 221. The button B1 is a button for driving of all of the indoor units 12 all together (all driving button). The button B2 is a button for stopping of all of the indoor units 12 all together (all stopping button). The button B3 is a button for individual driving of the indoor units 12 (driving button). The button B4 is a button for individual stopping of the indoor units 12 (stopping button). The button B5 is a button for setting the specifics (driving mode, temperature, humidity, air flow, air flow direction, and the like) of the operations of each of the indoor units 12 (specifics button). Here, a driving mode for cooling, a driving mode for heating, a driving mode for dehumidifying are included as the driving modes. The button B6 is a button for setting the driving schedule (normal schedule) for the indoor units 12 (driving schedule setting button). The driving schedule is a schedule which relates to the timing when the driving of the indoor units 12 is started, the timing when the driving of the indoor units 12 is stopped, and the driving content. The management screen 221 moves to the driving schedule setting screen which is not shown in the diagram due to any of the indoor units 12 being selected from the indoor units 12 which are displayed on the management screen and the driving schedule setting button B6 being pressed. Settings such as driving start timing, driving stop timing, driving content (driving mode, temperature, humidity, air flow, and air flow direction), and the like are possible in the driving schedule setting screen. The button B7 is a button which is used by a maintenance worker. When the button B7 is pressed, a screen (which is not shown in the diagrams) for inputting a specific ID or the like is displayed. When the specific ID is input into this screen, an operations screen for maintenance workers (refer to FIG. 5 and FIG. 6) is displayed.

Figure 5:
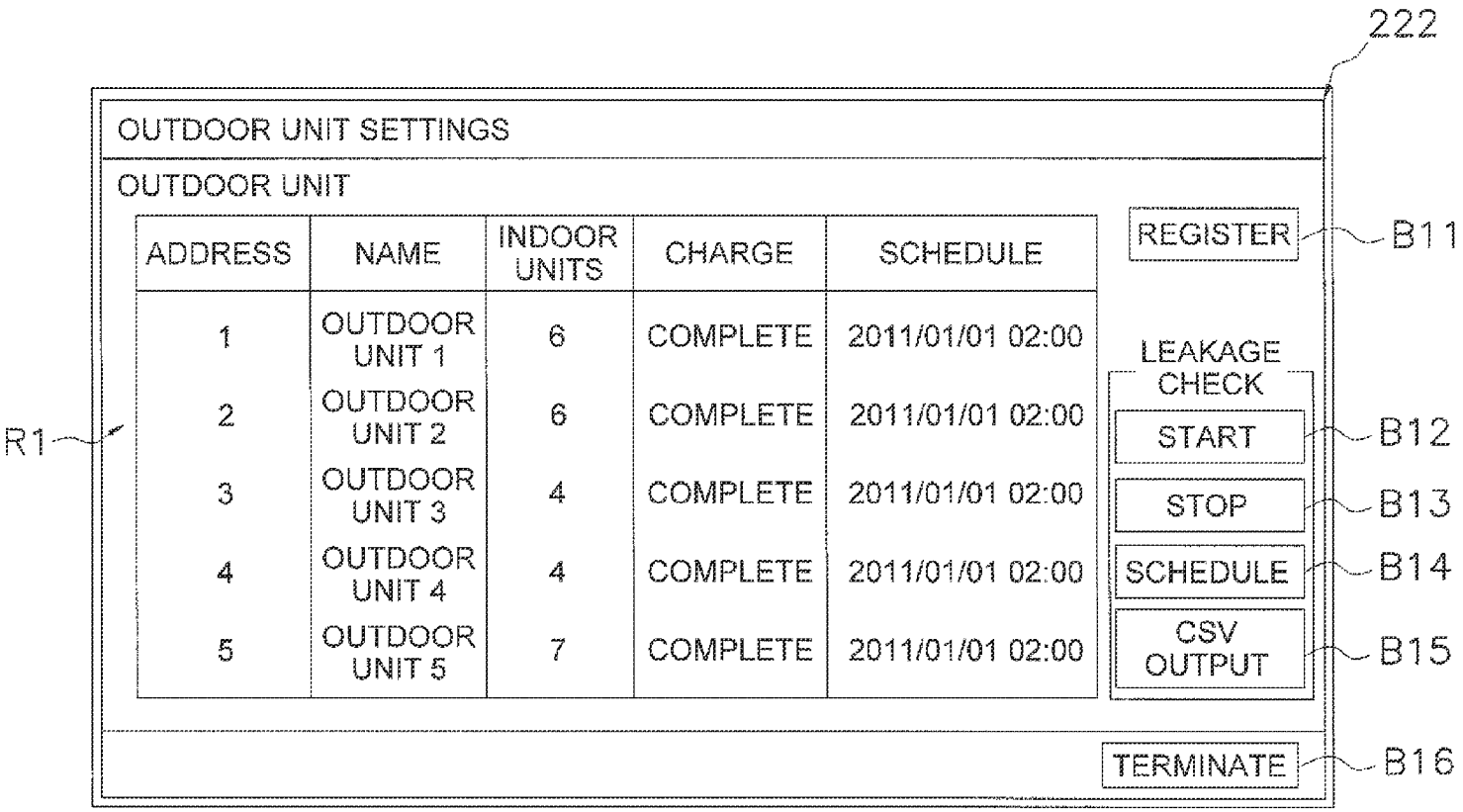
FIG. 5 is a diagram illustrating a screen (a detection driving start screen) for starting refrigerant leakage detection driving.
Figure 6:
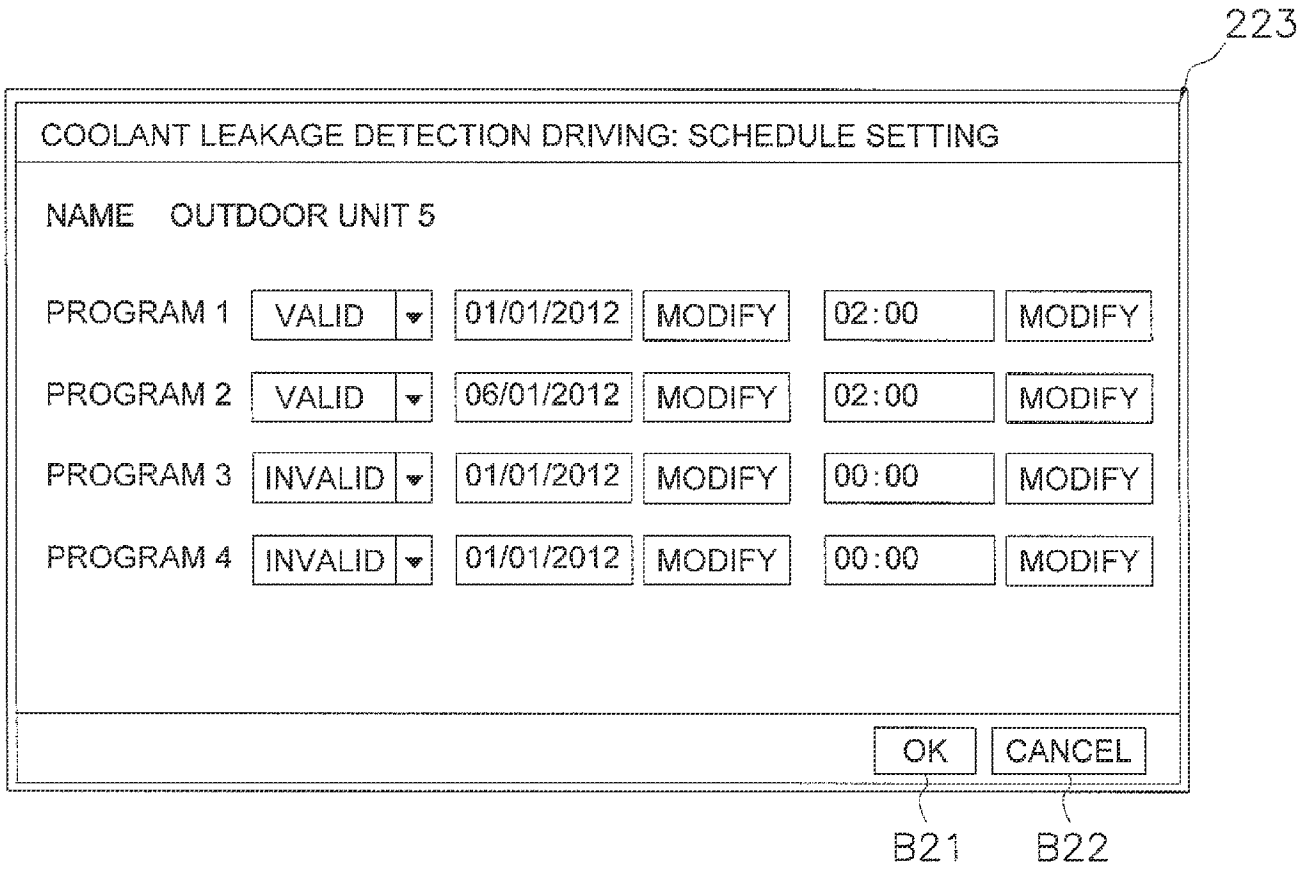
FIG. 6 is a diagram illustrating a screen (a detection schedule setting screen) for receiving inputting of settings for a schedule (a detection schedule) for refrigerant leakage detection driving.

A screen which relates to the refrigerant leakage detection driving is included in the operations screen for maintenance workers. The screen (detection driving start screen) 222 for starting the refrigerant leakage detection driving as shown in FIG. 5 and the screen (detection schedule setting screen) 223 which receives inputting of settings for the schedule for the refrigerant leakage detection driving (detection schedule) as shown in FIG. 6 are included in the screen which relates to the refrigerant leakage detection driving. The detection schedule is a schedule which relates to the date and time when the refrigerant leakage detection driving mode is executed.

A region R1 which displays a target for management and buttons B11 to B16 are provided in the detection driving start screen 222. The names of the outdoor units 11 which are to be the targets for management (for example, outdoor units 1 to 5), management addresses, the number of the indoor units 12 which configure the same refrigerant system in each of the outdoor units 11, the refrigerant filling situation, and the detection schedule (starting date and time) are displayed in the region R1. The detection schedule which is displayed in the region R1 is the date and time for the earliest out of the detection schedule which is set. The button B11 is a button which is used for newly registering a schedule for the refrigerant leakage detection driving (registration button). The button B12 is a button for starting the refrigerant leakage detection driving (detection start button). The button B13 is a button for stopping the refrigerant leakage detection driving (detection stop button). The button B14 is a button for setting a schedule for the refrigerant leakage detection driving (detection schedule setting button). When the detection schedule setting button B14 is pressed, the detection driving start screen 222 is switched to the detection schedule setting screen 223 (refer to FIG. 6). The detection schedule setting screen 223 is configured so that it is possible for four schedules to be set with regard to each of the outdoor units 11. In other words, it is possible for four starting dates and times for the refrigerant leakage detection driving with regard to the refrigerant circuit which includes each of the outdoor units 11 to be input into the detection schedule setting screen 223. By pressing an OK button B21 or a cancel button B22 in the detection schedule setting screen 223, the detection schedule setting screen 223 is switched to the detection driving start screen 222. The button B15 is a button for outputting the detection result which is acquired using the refrigerant leakage detection driving in CSV format (detection result output button). When the detection result output button B15 is pressed, information which relates to the date and time when the refrigerant leakage detection driving is carried out and the refrigerant leakage amount is output in CSV format as shown in FIG. 7 with regard to all of the outdoor units 11 which are registered. Information which relates to the refrigerant leakage detection driving up to 100 times in the past is shown for each of the outdoor units 11 in the detection results. In addition, the latest data is shown at the top of the CSV data (the top row in the data) which indicates the detection results. The button B16 is a button for terminating the settings which relate to the refrigerant leakage detection driving (terminate button). By pressing the terminate button B16, the detection driving start screen 222 is switched to the management screen 221.

Here, the various types of buttons B1 to B7 in the management screen 221 are invalidated when the refrigerant leakage detection driving which will be described later starts. In addition, the various types of settings which are input using the input section 23 are stored in the memory section 24 which will be described later.

(3-3) Memory Section

The memory section 24 is mainly configured from a ROM, a RAM, and a hard disk. Programs which are able to be executed by being read out by the control section 25 which will be described later are stored in the memory section 24. In addition, the memory section 24 mainly has a driving data storage region 24*a*, a driving schedule storage region 24*b*, a detection schedule storage region 24*c*, and a detection related data storage region 24*d*.

(3-3-1) Driving Data Storage Region

Driving data on the air conditioning device 10 which is acquired using an acquiring section 25*a* which will be described later is stored in the driving data storage region 24*a*. Driving data on the outdoor unit 11 and driving data on the indoor units 12 are included in the driving data as described above. In detail, the values for the state of the various types of components which are included in the outdoor unit 11, and the outdoor temperature and outdoor humidity which are detected by the outdoor unit 11 are included in the driving data for the outdoor unit 11, and the parameters for driving the indoor units 12, the indoor temperature, the indoor humidity, and values for the state of the various types of components which are included in the indoor unit 12 are included in the driving data for the indoor units 12.

(3-3-2) Driving Schedule Storage Region

The driving schedule which is input through the input section 23 and the driving schedule which is sent from the remote management device 30 are stored in the driving schedule storage region 24*b*. The driving schedule is a schedule which relates to the timing when the driving of the indoor units 12 is started, the timing when the driving of the indoor units 12 is stopped, and the driving content. The driving schedule which is stored in the driving schedule storage region 24*b* is overwritten with a new driving schedule which is newly set.

(3-3-3) Detection Schedule Storage Region

The detection schedule which is input through the input section 23 and the detection schedule which is sent from the remote management device 30 are stored in the detection schedule storage region 24*c*. The detection schedule is a schedule which relates to the date and time when the refrigerant leakage detection driving mode is carried out as described above. The detection schedule which is stored in the detection schedule storage region 24*c* is also overwritten with a detection schedule which is newly set.

(3-3-4) Detection Related Data Storage Region

The initial amount data and the current amount data which are acquired using the acquiring section 25*a* which will be described later are stored in the detection related data storage region 24*d*. The initial amount data is data which relates to the amount of refrigerant which is acquired using automatic driving for filling refrigerant which is carried out in the initial arrangement of the air conditioning device 10 as described above. The current amount data is data which relates to the amount of refrigerant which is acquired using the refrigerant leakage detection driving and is data which relates to the amount of refrigerant which is filled into the refrigerant circuit at the current point in time as described above.

In addition, determination history of the detection feasibility conditions which are determined using the detection feasibility determining section 25*c* which will be described later is also stored in the detection related data storage region 24*d*. Information which relates to errors which are generated prior to executing of the refrigerant leakage detection driving is included in the determination history. Information which relates to errors which are generated during executing of the refrigerant leakage detection driving may be included in the detection related data storage region 24*d*. Information which is acquired over a specific interval of time (an interval of one minute in the present embodiment) using the acquiring section 25*a* is included in the information which related to the errors.

Furthermore, results which are determined using a leakage determining section 25*d* which will be described later (detection results) are stored in the detection related data storage region 24*d* to be associated with the date and time when the refrigerant leakage detection driving is executed (refer to FIG. 7).

(3-4) Control Section

The control section 25 is mainly configured from a CPU and is mainly run as the acquiring section (reception section) 25*a*, a control instructions generating section (schedule executing section) 25*b*, the detection feasibility determining section 25*c*, the leakage determining section 25*d*, and a transmission section 25*e* by reading out and executing programs which are stored in the memory section 24.

(3-5-1) Acquiring Section

The acquiring section 25*a* collects the driving data for each of the air conditioning devices 10 over a specific interval or time (an interval of one minute in the present embodiment). In detail, the acquiring section 25*a* acquires the driving data on the outdoor units 11 from the control section 11*e* of each of the outdoor units 11. In addition, the acquiring section 25*a* collects the driving data on the indoor units 12 through the outdoor units 11. The driving data which is collected by the acquiring section 25*a* is stored in the driving data storage region 24*a*.

In addition, if the detection feasibility determining section 25*c* which will be described later confirms that there are no abnormalities in the state of communications between the air conditioning device 10 and the controller 20, the acquiring section 25*a* then acquires the initial amount data from the air conditioning device 10. In detail, the acquiring section 25*a* requests the initial amount data which is stored in the storage section 11*d* with regard to the outdoor units 11. The initial amount data which is acquired using the acquiring section 25*a* is stored in the detection related data storage region 24*d*.

Furthermore, after detection control instructions are transmitted with regard to the air conditioning device 10, the acquiring section 25*a* acquires the current amount data from the air conditioning device 10 over a specific period of time (110 minutes in the present embodiment). In detail, the control section 11*e* of the outdoor unit 11 calculates the amount of refrigerant in the refrigerant circuit over 110 minutes and the acquiring section 25*a* acquires the results which are calculated (the current amount data). The current amount data which is acquired using the acquiring section 25*a* is stored in the detection related data storage region 24*d*.

(3-5-2) Control Instructions Generating Section

The control instructions generating section 25*b* generates various types of control instructions which are executed by the air conditioning device 10 based on the settings which are received using the input section 23 and the settings which are received using the remote management device 30. An immediate schedule, the driving schedule, and the detection schedule are included in the settings which are received using the input section 23 and settings which are received using the remote management device 30. The immediate schedule is settings which are immediately run with conditions which are desired by a user.

The control instructions generating section 25*b* generates control instructions with priority given to control instructions based on the detection schedule over the driving schedule. In other words, the control instructions generating section 25*b* generates control instructions with priority given to control instructions (detection control instructions) for executing the refrigerant leakage detection driving with regard to the air conditioning device 10 in a case where the detection schedule which is to be executed is stored. The detection control instructions are instructions for all of the indoor units 12 which are included in the air conditioning device 10 to be compulsorily driven to cool and for the current amount data to be collected.

In addition, the control instructions generating section 25*b* generates control instructions for interrupting (or cancelling) controlling which is based on the driving schedule (interruption instructions) and transfers the interruption instructions to the transmission section 25*e* in a case where controlling which is based on the driving schedule is being performed in the air conditioning device 10 when control instructions which are based on the detection schedule are generated. Furthermore, the control instructions generating section 25*b* generates control instructions for restarting controlling which is based on the driving schedule which is interrupted (restarting instructions) and transfers the restarting instructions to the transmission section 25*e* when the refrigerant leakage detection driving is completed and detection results are acquired after the interruption instructions are generated.

Here, the control instructions generating section 25*b* transfers the detection control instructions to the transmission section 25*e* after the detection feasibility determining section 25*c* which will be described later determines that the refrigerant leakage detection driving is possible. The detection control instructions are transmitted to the air conditioning device 10 using the transmission section 25*e* which will be described later. On the other hand, the detection control instructions are not transmitted to the transmission section 25*e* in a case where the detection feasibility determining section 25*c* determines that the refrigerant leakage detection driving is not possible.

Furthermore, the control instructions generating section 25*b* generates instructions for performing a specific display (display instructions) on the display section of the air conditioning device 10 (any or all of the display section of the remote controller 12*c*, the display section 22 of the controller 22, and a display section 32 of the remote management device 30) when the detection control instructions are transferred to the transmission section 25*e* and also transfers the display instructions to the transmission section 25*e*. Here, the specific display is a display which accompanies the refrigerant leakage detection driving and is a display which indicates that the air conditioning device 10 is carrying out the refrigerant leakage detection driving. That is, the air conditioning device 10 shows the display that the refrigerant leakage detection driving is being carried out on the display section along with carrying out the refrigerant leakage detection driving when the detection control instructions are transmitted to the air conditioning device 10 using the transmission section 25*e*.

In addition, the control instructions generating section 25*b* further generates restriction instructions when the detection control instructions are transferred to the transmission section 25*e* and transfers the restriction instructions to the transmission section 25*e* at the same time. The restriction instructions are instructions for carrying out restrictions so that the operations inputting section of the air conditioning device 10 does not receive inputting of the specific operations. Here, the specific operations are, for example, an operation of turning the power off, an operation of stopping driving, an operation of changing the driving mode, and the like as described above. Here, at this time, it is preferable to restrict so that inputting is also not received from the input section of the remote controller 12*c* and the input section 23 of the controller 20.

Furthermore, the control instructions generating section 25*b* generates instructions for terminating the specific display (display termination instructions) and instructions for cancelling the restricting of inputting operations (cancellation instructions) when acquiring of the current amount data using the acquiring section 25*a* is completed. The display termination instructions and the cancellation instructions are also transferred to the transmission section 25*e*.

(3-5-3) Detection Feasibility Determining Section

The detection feasibility determining section 25*c* determines the feasibility of the refrigerant leakage detection driving in the air conditioning device 10 which is the target based on specific detection feasibility conditions when the detection control instructions are generated using the control instructions generating section 25*b* as described above. In other words, the detection feasibility determining section 25*c* confirms that there is not a state where the refrigerant leakage detection driving is not possible (inappropriate state) in the air conditioning device 10 which is the target of the refrigerant leakage detection driving. The specific detection feasibility conditions are conditions which relate to the state of communications with the air conditioning device 10 and the driving state of the air conditioning device 10. In detail, the specific detection feasibility conditions are conditions which relate to the presence or absence of communication abnormalities, the refrigerant filling state, and the driving state of the air conditioning device 10 (undergoing inspection, in emergency shutdown, or abnormality generated).

In more detail, first, the detection feasibility determining section 25*c* determines the presence or absence of communication abnormalities between the controller 20 and the outdoor unit 11. In detail, the detection feasibility determining section 25*c* performs communication a specific number of times (four times in the present embodiment) with regard to the outdoor unit 11 and it is determined that the refrigerant leakage detection driving is not possible in a case where communication is not established within the specific number of times.

In a case where communication is established, the detection feasibility determining section 25*c* then determines the refrigerant filling state in the refrigerant circuit based on the initial amount data which is stored in the detection related data storage region 24*d*. In detail, the detection feasibility determining section 25*c* determines whether or not the amount of the refrigerant filled in the air conditioning device 10 which is a target for the refrigerant leakage detection driving is not "0". The detection feasibility determining section 25*c* determines that the refrigerant leakage detection driving is not possible in a case where the value which indicates the initial amount (the amount of refrigerant which is initially filled into the refrigerant circuit) is "0".

Furthermore, the detection feasibility determining section 25*c* determines whether or not the air conditioning device 10 is being driven normally based on the driving data which is stored in the driving date storage region 24*a*. In detail, the detection feasibility determining section 25*c* determines whether the air conditioning device 10 is undergoing inspection, is in emergency shutdown, or an abnormality has been generated. In more detail, the detection feasibility determining section 25*c* determines whether the outdoor unit 11 and the indoor units 12 which configure the same refrigerant circuit as the outdoor unit 11 are undergoing inspection, are in emergency shutdown, or an abnormality has been generated. The detection feasibility determining section 25*c* determines that the refrigerant leakage detection driving is not possible in a case where any device is undergoing inspection, any device is in emergency shutdown, or an abnormality has been generated in any device among the devices out of the outdoor unit 11 and the indoor units 12 which configure the refrigerant circuit. The detection feasibility determining section 25*c* stores the determination history of the detection feasibility conditions in the detection related data storage region 24*d*.

Here, the detection feasibility determining section 25*c* displays a dialogue which prompts confirming of executing of the refrigerant leakage detection driving on the display section 22 (refer to FIG. 8) before determining the feasibility of the refrigerant leakage detection driving in a case where the detection control instructions which are generated by the control instruction generating section 25*b* are based on the immediate schedule. In addition, in a case where any of the detection feasibility conditions are not satisfied by the air conditioning device 10, the detection feasibility determining section 25*c* displays a dialogue which shows the reasoning for this on the display section 22 (refer to FIG. 9).

(3-5-4) Leakage Determining Section

The leakage determining section 25*d* determines that there is a refrigerant leak based on the detection related data which is stored in the detection related data storage region 24*d*. In detail, the leakage determining section 25*d* determines the presence or absence of a refrigerant leak by comparing the initial amount data and the current amount data. In detail, the leakage determining section 25*d* calculates a refrigerant amount x which has leaked (a leakage amount) by comparing a refrigerant amount Qi which is filled into the refrigerant circuit when installing the air conditioning device 10 and a refrigerant amount Qp which is currently filled in the refrigerant circuit ($x=Qi-Qp$).

The results which are determined using the leakage determining section 25*d* are stored in the detection related data storage region 24*d* to be associated with the date and time when the refrigerant leakage detection driving is executed (refer to FIG. 7).

(3-5-5) Transmission Section

The transmission section 25*e* transmits various types of instructions which are set by the controller 20 and various types of instructions which are sent from the remote management device 30 to the air conditioning device 10. In other words, the transmission section 25*e* transmits the control instructions which are generated by the control instructions generating section 25*b* and the control instructions which are sent from the remote management device 30 with regard to the air conditioning device 10.

In addition, the transmission section 25*e* transmits the driving data which is stored in the driving data storage region 24*a* to the remote management device 30 in specific intervals of time (every 30 minutes in the present embodiment).

(4) Remote Management Device

Figure 10:
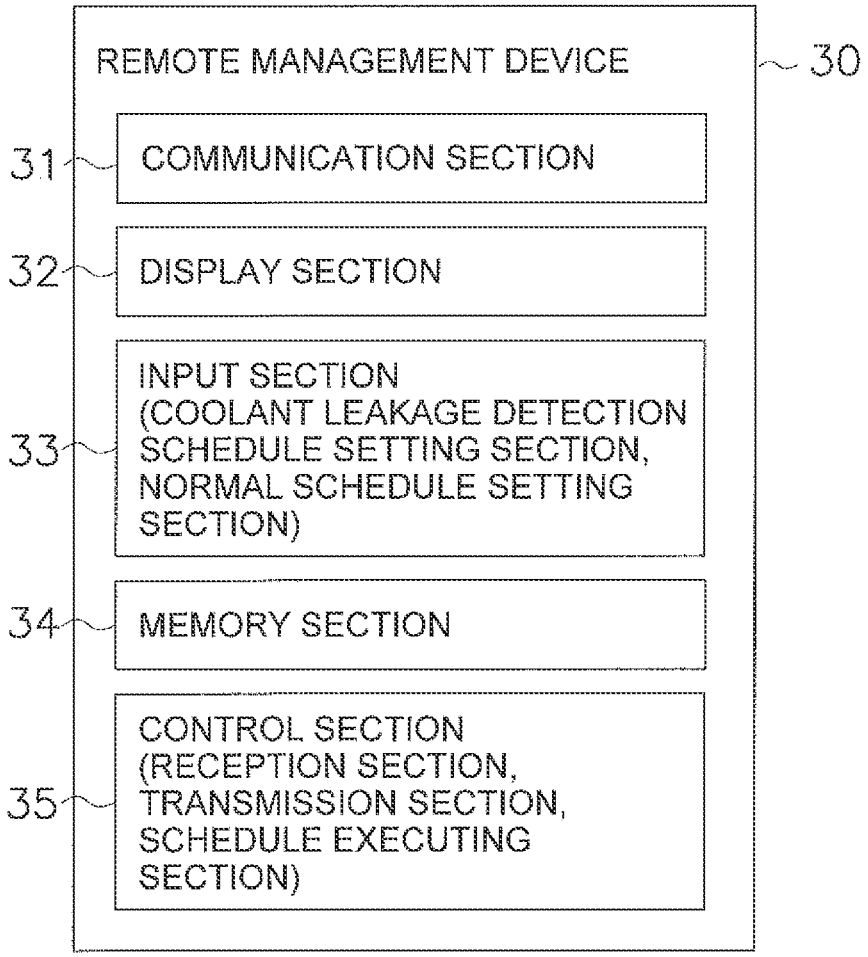
FIG. 10 is a diagram illustrating a configuration of a remote management device.

As shown in FIG. 10, the remote management device 30 is a server computer which is mainly configured from a communication section 31, the display section 32, an input section (a refrigerant leakage detection schedule setting section and a normal schedule setting section) 33, a memory section 34, and a control section (a reception section, a transmission section, and a schedule executing section) 35. The remote management device 30 has a function of monitoring and controlling the air conditioning device 10 through the controller 20. The remote management device 30 according to the present embodiment executes the refrigerant leakage detection driving in the air conditioning device 10 through the controller 20.

(4-1) Communication Section

The communication section 31 is a network interface where it is possible for the remote management device 30 to connect with the Internet 60.

(4-2) Display Section

Figure 11:
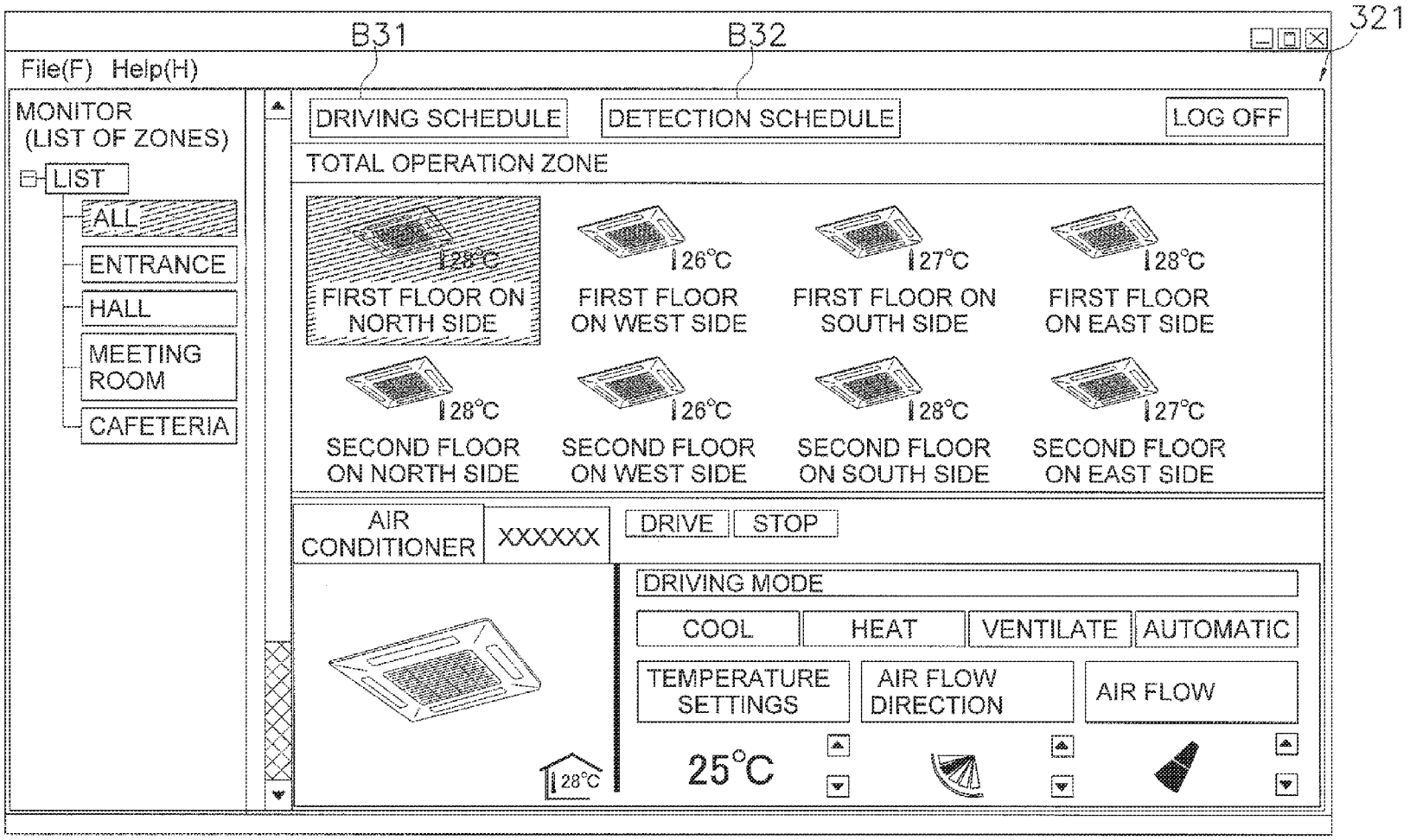
FIG. 11 is a diagram illustrating a management screen which is displayed on a display section of a remote management device.

The display section 32 is mainly configured from a display. A management screen 321 for the air conditioning device 10 is displayed on the display section 32 as shown in FIG. 11. The driving data for the air conditioning device 10 is shown on the management screen 321. It is possible to monitor the driving situation of the air conditioning device 10 and to control the air conditioning device 10 from a distance from the building 90 by performing setting of the air conditioning device 10 using the management screen 321.

For example, a plurality of buttons B31 and B32 are provided in the management screen 321 as shown in FIG. 11. By clicking on the buttons B31 and B32, it is possible to perform more detailed settings with regard to controlling of the air conditioning device 10. In detail, the button B31 is a button for setting the driving schedule (driving schedule setting button). In addition, the button B32 is a button for setting the detection schedule. By clicking on the button B32, the management screen 321 is switched to a screen which relates to the refrigerant leakage detection driving. The screen which relates to the refrigerant leakage detection driving is the same screen as the screen which is displayed in the display section 22 of the controller 20. In detail, the screen (detection driving start screen) 222 for starting the refrigerant leakage detection driving as shown in FIG. 5 and the screen (detection schedule setting screen) 223 for setting the schedule for the refrigerant leakage detection driving (detection schedule) as shown in FIG. 6 are included in the screen which relates to the refrigerant leakage detection driving.

(4-3) Input Section

The input section 33 is mainly configured from a mouse and a keyboard.

(4-4) Memory Section

The memory section 34 is mainly configured from a ROM, a RAM, and a hard disk. Programs which are able to be executed by being read out by the control section 35 which will be described later are stored in the memory section 34.

The memory section 34 stores the driving data and the detection related data for the air conditioning device 10 which the control section 35 which will be described later acquires through the controller 20. In addition, the memory section 34 stores various types of settings (the immediate schedule, settings for the driving schedule, and settings for the detection schedule) which are input through the input section 33. Here, when various types of information (the driving data, various types of settings, and the like for the air conditioning device 10) are acquired from the controller 20 using the control section 35, the corresponding information out of the information which is stored in the memory section 34 is overwritten using the new information.

(4-5) Control Section

The control section 35 is mainly configured from a CPU. The control section 35 reads out and executes programs which are stored in the memory section 34. The control section 35 generates the control instructions based on the settings (the immediate schedule, settings for the driving schedule, and settings for the detection schedule) which are input through the input section 33. The control section 35 transmits the control instructions to the controller 20 through the Internet 60.

In addition, the control section 35 acquires various types of information (the driving data, various types of settings, and the like) from the controller 20 and stores the information which is acquired in the memory section 34.

(5) Process Flow

Figure 12:
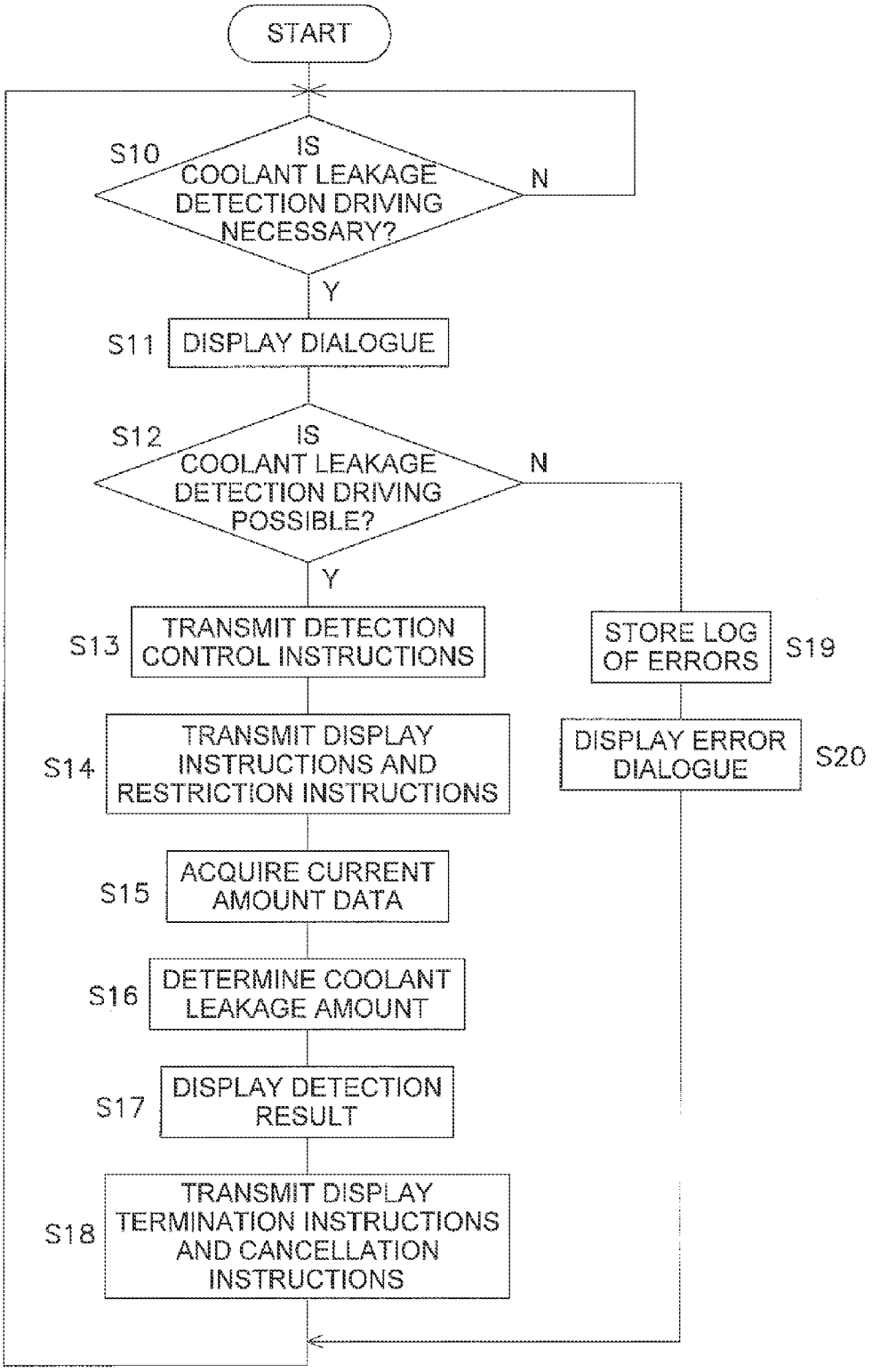
FIG. 12 is a diagram illustrating a process flow according to refrigerant leakage detection driving which is based on an immediate schedule.
Figure 13:
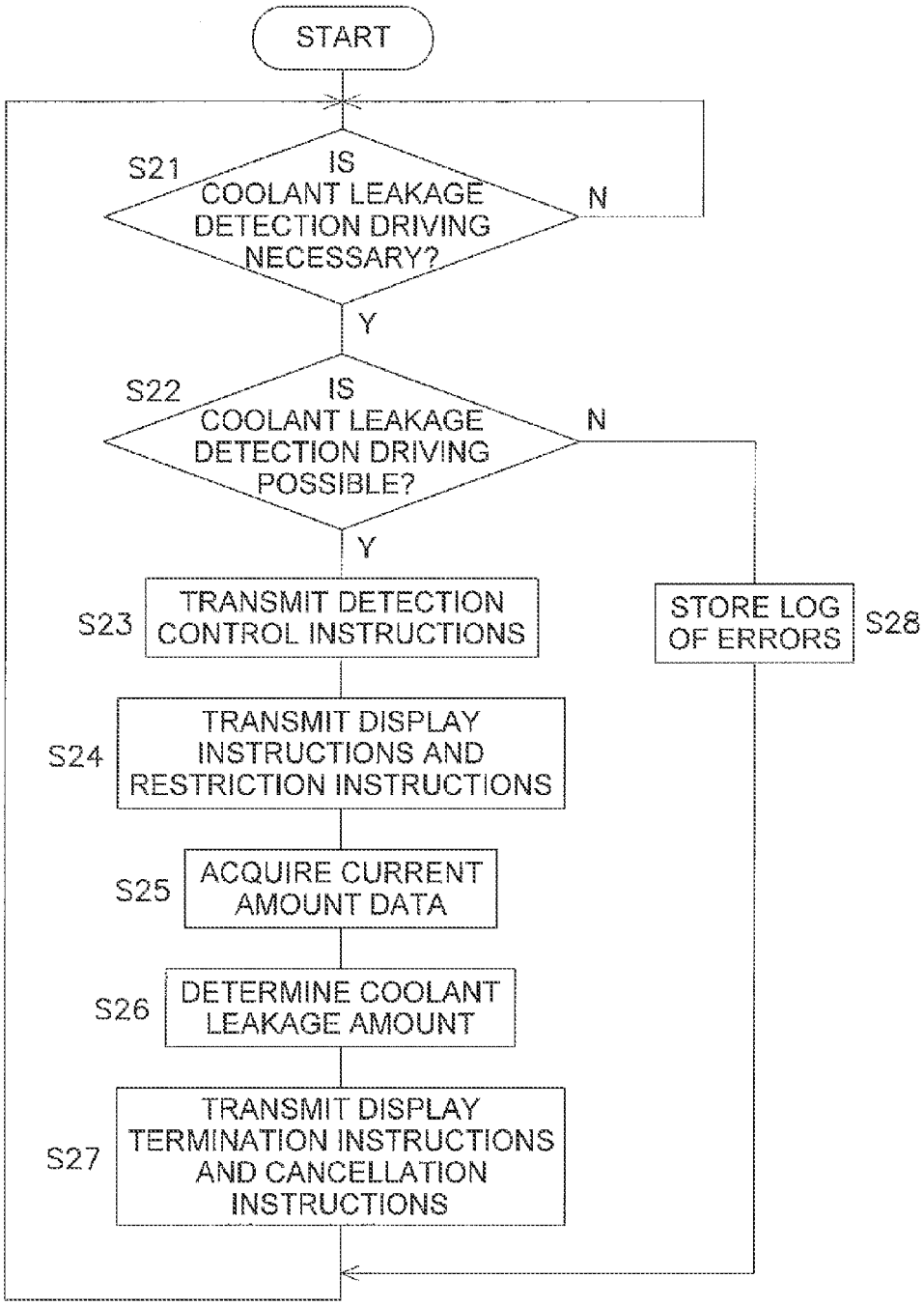
FIG. 13 is a diagram illustrating a process flow according to refrigerant leakage detection driving which is based on a detection schedule.
Figure 14:
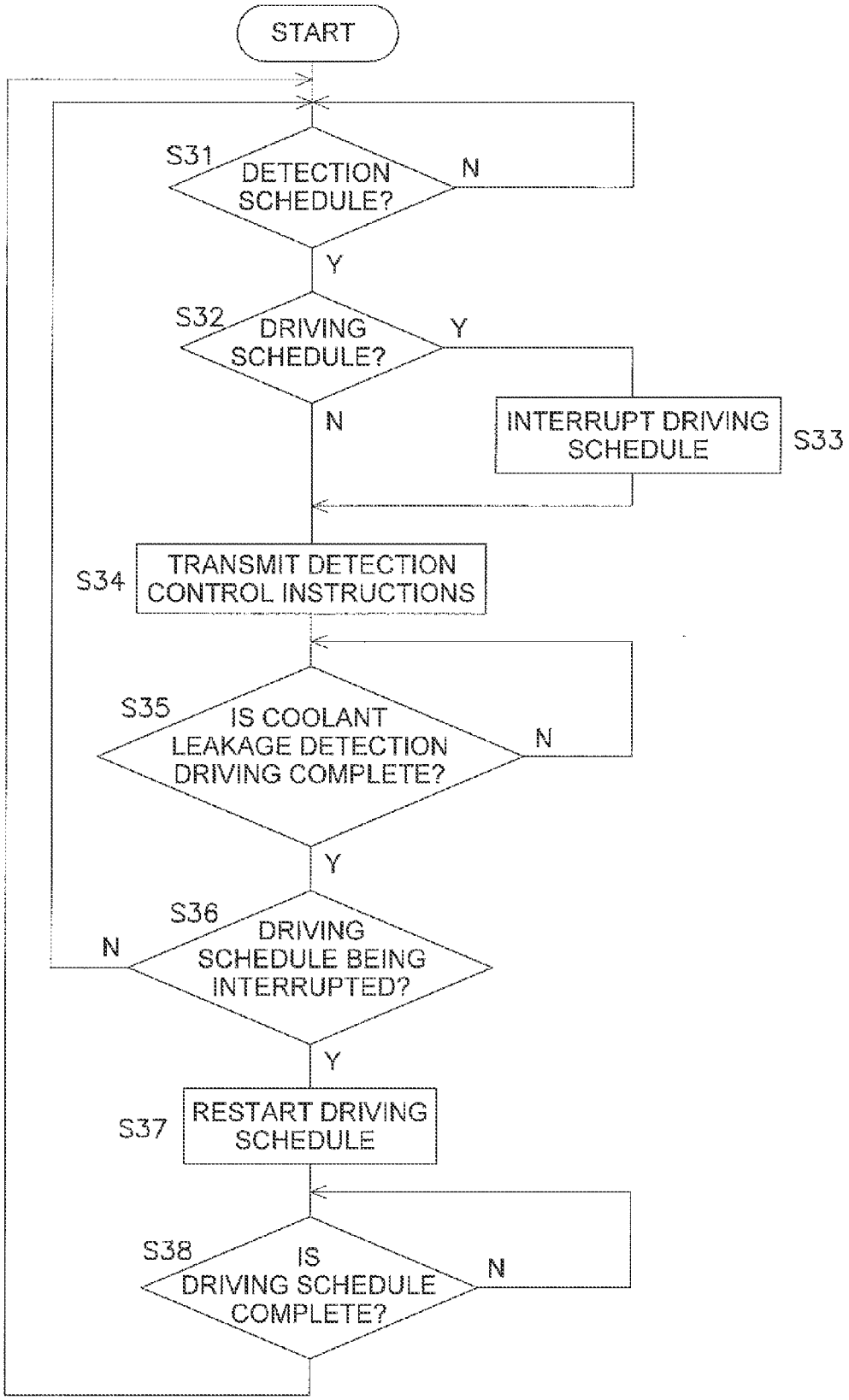
FIG. 14 is a diagram illustrating a process flow where a detection schedule is prioritized with regard to a driving schedule.

Next, a process flow using the controller 20 according to the refrigerant leakage detection driving will be described with reference to FIG. 12 to FIG. 14. FIG. 12 illustrates a process flow according to the refrigerant leakage detection driving which is based on the immediate schedule. FIG. 13 illustrates a process flow according to the refrigerant leakage detection driving which is based on the detection schedule. FIG. 14 illustrates a process flow where the detection schedule is prioritized with regard to the driving schedule.

(5-1) Refrigerant Leakage Detection Driving Based on Immediate Schedule

First, a process flow according to the refrigerant leakage detection driving which is based on the immediate schedule will be described using FIG. 12. As described above, the immediate schedule is settings which are received using the input section 23 of the controller 20 or the input section 33 of the remote management device 30.

In step S10, it is determined whether or not there is a request for the refrigerant leakage detection driving. There is waiting in step S10 until there is a request for the refrigerant leakage detection driving and the process flow proceeds to step S11 when there is a request.

Figure 8:
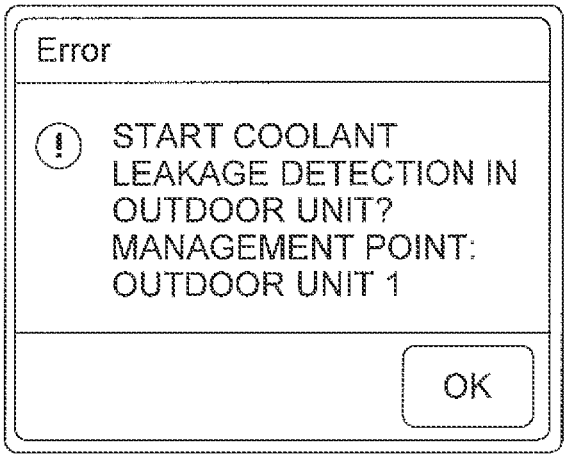
FIG. 8 is a diagram illustrating an example of a dialogue which prompts confirming of executing of refrigerant leakage detection driving.

In step S11, a dialogue which prompts confirming of executing of the refrigerant leakage detection driving is displayed (refer to FIG. 8). At this time, the dialogue is displayed in the device where the immediate schedule of the refrigerant leakage detection driving is set. That is, the dialogue is displayed in the display section 22 of the controller 20 if the immediate schedule is set using the controller 20, and the dialogue is displayed in the display section 32 of the remote management device 30 if the immediate schedule is set using the remote management device 30. After this, the process flow proceeds to step S12.

In step S12, feasibility of the refrigerant leakage detection driving is determined. The feasibility of the refrigerant leakage detection driving is determined based on the detection feasibility conditions. In detail, the presence or absence of communication abnormalities between the controller 20 and the air conditioning device 10 (the outdoor unit 11) which is the target of the refrigerant leakage detection driving, whether or not the refrigerant is filled in the refrigerant circuit of the air conditioning device 10 which is the target, whether or not the air conditioning device 10 which is the target is undergoing inspection, whether or not the air conditioning device 10 which is the target is in emergency shutdown, whether or not an abnormality has occurred in the air conditioning device 10 which is the target are each determined. In step S12, the process flow proceeds to step S13 when it is determined that the refrigerant leakage detection driving is possible.

In step S13, instructions for carrying out the refrigerant leakage detection driving (detection control instructions) are transmitted to the air conditioning device 10. The air conditioning device 10 which receives the detection control instructions switches to the refrigerant leakage detection driving mode, performs compulsorily driving for cooling, and starts to collect the current amount data. Next, the process flow proceeds to step S14.

In step S14, the display instructions and the restriction instructions are sent to the air conditioning device 10. The display instructions are instructions for performing the specific display in the air conditioning device 10 as described above. The specific display is a display which accompanies the refrigerant leakage detection driving and is a display which indicates that the air conditioning device 10 is carrying out the refrigerant leakage detection driving. The restriction instructions are instructions for carrying out restrictions so that inputting of the specific operations are not received by the air conditioning device 10 as described above. Thereby, that the refrigerant leakage detection driving is being carried out is shown in the air conditioning device 10 and there is a state where inputting of the specific operations are not received from the outside. After this, the process flow proceeds to step S15.

In step S15, the current amount data is acquired from the air conditioning device 10 where the refrigerant leakage detection driving is carried out. In detail, data which relates to the amount of refrigerant which is currently included in the refrigerant circuit of the air conditioning device 10 (current amount data) is acquired from the control section 11*e* of the outdoor unit 11. The current amount data which is collected by the acquiring section 25*a* is stored in the detection related data storage region 24*d*. After this, the process flow proceeds to step S16.

In step S16, the refrigerant leakage amount is determined. In detail, data which is stored in the detection related data storage region 24*d* is referenced, and the leakage determining section 25*d* calculates the refrigerant amount x which has leaked (the leakage amount) based on the refrigerant amount Qi which is filled into the refrigerant circuit when arranging the air conditioning device 10 and the refrigerant amount Qp which is currently filled in the refrigerant circuit (x=Qi−Qp). The determination result (the detection result) in step S16 is stored in the detection related data storage region 24*d* to be associated with the date and time when the refrigerant leakage detection driving is executed (refer to FIG. 7). Next, the process flow proceeds to step S17.

In step S17, the detection results are displayed on the display sections 22 and 32. At this time, the detection results are displayed on the device where there is the request for the refrigerant leakage detection driving. That is, the detection results are displayed in the display section 22 of the controller 20 if the request for the refrigerant leakage detection driving is generated using the controller 20 and the detection results are displayed in the display section 32 of the remote management device 30 if the request for the refrigerant leakage detection driving is generated using the remote management device 30. After this, the process flow proceeds to step S18.

In step S18, the display termination instructions and the cancellation instructions are transmitted to the air conditioning device 10. As described above, the display termination instructions are instructions for terminating the displaying of the specific display and the cancellation instructions are instructions for cancelling the restrictions on inputting. Thereby, the specific display disappears and the restriction on inputting are cancelled in the air conditioning device 10.

On the other hand, if it is determined in step S12 that the refrigerant leakage detection driving is not possible, the process flow proceeds to step S19. In step S19, a log on items which are determined to be not possible (errors) is stored in the detection related data storage region. After this, the process flow proceeds to step S20.

Figure 9:
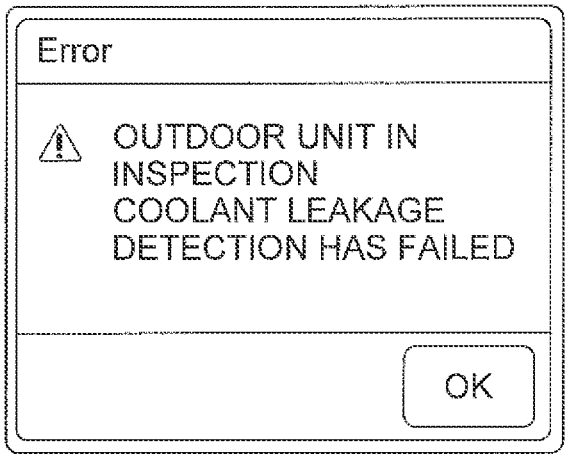
FIG. 9 is a diagram illustrating an example of a dialogue which appears in a case where detection feasibility conditions are not satisfied.

In step S20, an error dialogue such as shown in FIG. 9 is displayed on the display sections 22 and 32. At this time, the error dialogue is also displayed on the device where the immediate schedule for the refrigerant leakage detection driving is set. That is, the error dialogue is displayed in the display section 22 of the controller 20 if the immediate schedule is set using the controller 20, and the error dialogue is displayed in the display section 32 of the remote management device 30 if the immediate schedule is set using the remote management device 30.

(5-2) Refrigerant Leakage Detection Driving Based on Detection Schedule

Next, a process flow according to the refrigerant leakage detection driving which is based on the detection schedule will be described using FIG. 13. As described above, the detection schedule is also settings which are received using the input section 23 of the controller 20 or the input section 33 of the remote management device 30.

First, in step S21, it is determined whether or not the refrigerant leakage detection driving is necessary based on the detection schedule. There is waiting in step S21 until the refrigerant leakage detection driving is necessary, and the process flow proceeds to step S22 when the refrigerant leakage detection driving is necessary.

In step S22, the feasibility of the refrigerant leakage detection driving is determined. The feasibility of the refrigerant leakage detection driving is determined based on the detection feasibility conditions. In detail, the presence or absence of communication abnormalities between the controller 20 and the air conditioning device 10 (the outdoor unit 11) which is the target of the refrigerant leakage detection driving, whether or not the refrigerant is filled in the refrigerant circuit of the air conditioning device 10 which is the target, whether or not the air conditioning device 10 which is the target is undergoing inspection, whether or not the air conditioning device 10 which is the target is in emergency shutdown, whether or not an abnormality has occurred in the air conditioning device 10 which is the target are each determined. In step S22, the process flow proceeds to step S23 when it is determined that the refrigerant leakage detection driving is possible.

In step S23, instructions for carrying out the refrigerant leakage detection driving (detection control instructions) are transmitted to the air conditioning device 10. The air conditioning device 10 which receives the detection control instructions switches to the refrigerant leakage detection driving mode, all of the indoor units 12 perform compulsorily driving for cooling, and collecting of the current amount data is started. Next, the process flow proceeds to step S24.

In step S24, the display instructions and the restriction instructions are sent to the air conditioning device 10. Thereby, that the refrigerant leakage detection driving is being carried out is shown in the air conditioning device 10 and there is a state where inputting of the specific operations are not received from the outside. Next, the process flow proceeds to step S25.

In step S25, the current amount data is acquired from the air conditioning device 10 where the refrigerant leakage detection driving is carried out. In detail, data which relates to the amount of refrigerant which is currently included in the refrigerant circuit of the air conditioning device 10 (current amount data) is acquired from the control section 11*e* of the outdoor unit 11. The current amount data which is collected by the acquiring section 25*a* is stored in the detection related data storage region 24*d*. After this, the process flow proceeds to step S26.

In step S26, the refrigerant leakage amount is determined. In detail, data which is stored in the detection related data storage region 24*d* is referenced, and the refrigerant amount x which has leaked (the leakage amount) is calculated based on the refrigerant amount Qi which is filled into the refrigerant circuit when arranging the air conditioning device 10 and the refrigerant amount Qp which is currently filled in the refrigerant circuit (x=Qi−Qp). The determination result (the detection result) in step S26 is stored in the detection related data storage region 24*d* to be associated with the date and time when the refrigerant leakage detection driving is executed (refer to FIG. 7). The detection results which are stored in the detection related data storage region are output in CSV format by receiving input using the button B15 in the detection driving start screen 222.

In step S27, the display termination instructions and the cancellation instructions are transmitted to the air conditioning device 10. As described above, the display termination instructions are instructions for terminating the displaying of the specific display and the cancellation instructions are instructions for cancelling the restrictions on inputting. Thereby, the specific display disappears and the restrictions on inputting are cancelled in the air conditioning device 10.

On the other hand, if it is determined in step S22 that the refrigerant leakage detection driving is not possible, a log on items which are determined to be not possible (errors) is stored in the detection related data storage region in step S28. The log which is stored in the detection related data storage region is output in CSV format by receiving input using the button B15 in the detection driving start screen 222.

(5-3) Prioritizing Process

Next, a process flow where the detection schedule is prioritized with regard to the driving schedule will be described using FIG. 14.

First, in step S31, whether or not there is the detection schedule is determined. The process flow proceeds to step S32 in a case where there is the detection schedule in step S31.

In step S32, whether or not there is the driving schedule which is currently being executed is determined. The process flow proceeds to step S33 in a case where there is the driving schedule which is currently being executed in step S32. On the other hand, the process flow proceeds to step S34 in a case where there is no driving schedule which is currently being executed in step S32.

In step S33, the driving schedule being executed is interrupted. In other words, the control content of the air conditioning device 10 which is based on the driving schedule is cancelled and the air conditioning device 10 is stopped. After this, the process flow proceeds to step S34.

In step S34, the detection control instructions are transmitted. That is, the driving leakage detection driving is executed in the air conditioning device 10. After this, the process flow proceeds to step S35.

In step S35, whether or not the driving leakage detection driving is completed is determined. There is waiting in step S35 until the refrigerant leakage detection driving is completed, and the process flow proceeds to step S36 when the refrigerant leakage detection driving is completed.

In step S36, whether or not there is the driving schedule which is being interrupted is determined. The process flow returns to step S31 in a case where there is no driving schedule which is being interrupted in step S36. On the other hand, the process flow proceeds to step S37 in a case where there is the driving schedule which is being interrupted in step S36.

In step S37, controlling of the air conditioning device 10 which is based on the driving schedule which is being interrupted is restarted. After this, the process flow proceeds to step S38 and returns to step S31 in a case where the driving schedule which is completed.

(6) Features (6-1)

In the cooling device management system 100 according to the present embodiment described above, it is possible to set the detection schedule according to the refrigerant leakage detection driving of the air conditioning device 10 using the controller 20 or the remote management device 30 which are at locations which are separated from the air conditioning device 10. The air conditioning device 10 executes the refrigerant leakage detection driving based on the detection schedule. Thereby, it is possible to carry out the refrigerant leakage detection driving with regard to the air conditioning device 10 without a maintenance worker travelling to the location where the air conditioning device 10 is disposed. Accordingly, it is possible to reduce the burden and costs even in a case where there is an increase in the number of the air conditioning devices 10 which are the targets for carrying out the refrigerant leakage detection driving.

(6-2)

In the cooling device management system 100 according to the present embodiment described above, the display instructions are transmitted along with the instructions to carry out the refrigerant leakage detection driving (the detection control instructions) being transmitted to the air conditioning device 10. The display instructions are instructions for performing the specific display which indicates that the refrigerant leakage detection driving is being carried out in the display section (which is not shown in the diagrams) of the air conditioning device 10. Thereby, it is possible to notify users of the cooling device that the cooling device is carrying out the refrigerant leakage detection driving.

(6-3)

In addition, in the cooling device management system 100 according to the present embodiment described above, the restriction instructions are transmitted along with the instructions to carry out the refrigerant leakage detection driving (the detection control instructions) being transmitted to the air conditioning device 10. The restriction instructions are instructions for carrying out restrictions so that inputting of the specific operations are not received in the air conditioning device 10. Thereby, there is a state in the air conditioning device 10 where inputting of the specific operations is not received from the outside while the refrigerant leakage detection driving is being carried out. Thereby, it is possible to acquire accurate detection results since it is possible to reliably execute and complete the refrigerant leakage detection driving.

(6-4)

In addition, in the cooling device management system 100 according to the present embodiment described above, the state of communication with the air conditioning device 10, the driving state of the air conditioning device 10, and the like are determined before the refrigerant leakage detection driving is carried out with regard to the air conditioning device 10. In detail, the controller 20 determines whether or not there is a state, where it is possible to execute the refrigerant leakage detection driving in the air conditioning device 10, based on the specific detection feasibility conditions. The controller 20 does not generate the instructions to carry out the refrigerant leakage detection driving in a case where accurate detection results will not be acquired. As a result, it is possible to improve the reliability of the detection results.

In addition, the controller 20 stores the history when the refrigerant leakage detection driving is not possible in a case where it is determined that it is not possible to carry out the refrigerant leakage detection driving. Thereby, it is possible to easily specify the reasons for not being able to carry out the refrigerant leakage detection driving.

(6-5)

Furthermore, in the cooling device management system 100 according to the present embodiment described above, it is possible to set the driving schedule in addition to the detection schedule. The driving schedule is a schedule for starting driving and stopping driving of the air conditioning device 10. The detection schedule is executed by being given priority over the driving schedule in a case where both the driving schedule and the detection schedule are set with the same timing or time zone. The refrigerant leakage detection driving is driving where data which relates to the amount of refrigerant which is currently filled in the refrigerant circuit (current amount data) is collected by all of the indoor units 12 being compulsorily driven to cool irrespective of the air conditioning environment which is desired by the users. It is not preferable for the air conditioning device 10 to be left in a state where there is a refrigerant leak since reductions in performance or malfunctions of the air conditioning device 10 will result from cases where there are refrigerant leaks. In particular, the air conditioning device 10 which is used in the present embodiment uses a simple R32 refrigerant. R32 is a refrigerant which is slightly flammable. It is extremely important to prevent leaks of refrigerant which is slightly flammable. In addition, there are cases where it is a requirement that the results of periodic detections of refrigerant leaks are to be reported. In the cooling device management system 100 according to the present embodiment described above, the air conditioning device 10 is controlled so that the refrigerant leakage detection driving which is based on the detection schedule is executed by being given priority with regard to driving which is based on the normal driving schedule. Thereby, it is possible to reliably check for refrigerant leaks in the air conditioning device 10.

(6-6)

In addition, in the cooling device management system 100 according to the present embodiment described above, driving which is based on the normal schedule is restarted after the refrigerant leakage detection driving is completed in the air conditioning device 10 in a case where driving of the air conditioning device 10 which is based on the normal schedule is cancelled in order to carry out the refrigerant leakage detection driving which is based on the refrigerant leakage detection schedule. Thereby, it is possible to automatically restart the normal schedule after the refrigerant leakage detection driving is completed even in a case where driving which is based on the driving schedule is restricted (cancelled) in order to carry out the refrigerant leakage detection driving.

(7) Modified Examples

(7-1) Modified Example A

In the cooling device management system 100 according to the present embodiment described above, one controller 20 which is disposed in one building 90 is connected with the remote management device 30 as shown in FIG. 1, but the number of the controllers 20 which are connected with the remote management device 30 is not limited to this. That is, the remote management device 30 may be connected with a plurality of the controllers 20 which are respectively disposed at a plurality of the buildings 90. In addition, a plurality of the controllers 20 may be disposed at one building 90, and the remote management device 30 may be connected with the plurality of controllers 20 which are disposed at the one building 90.

(7-2) Modified Example B

In the embodiment described above, the controller 20 generates control instructions based on the settings which are received using the remote management device 30. Here, the remote management device 30 may be provided with a function which is the same as the control section 25 of the controller 20. Even in a case with this configuration, the refrigerant leakage detection driving is executed at a location which is separated from the location where the air conditioning device 10 is disposed, and it is possible to confirm the results of the refrigerant leakage detection driving at the location which is separated from the air conditioning device 10.

(7-3) Modified Example C

In the embodiment described above, transmitting of the detection control instructions is performed in a step different from a step in which the transmitting of the display instructions and the restriction instructions is performed, but all of the detection control instructions, the display instructions, and the restriction instructions may be transmitted at substantially the same time.

In addition, in the embodiment described above, the display termination instructions and the cancellation instructions are transmitted to the air conditioning device 10 in step S18 after the detection results are displayed in step S17, but the display termination instructions and the cancellation instructions may be transmitted to the air conditioning device 10 before the detection results are displayed.

(7-4) Modified Example D

In the cooling device management system 100 according to the present embodiment described above, it is possible to use the remote management device 30 to confirm the results of the refrigerant leakage detection driving (detection results) which are acquired using the controller 20, but there may be a configuration where it is possible to use another mobile terminal to confirm the detection results which are acquired using the controller 20.

(7-5) Modified Example E

In the cooling device management system 100 according to the present embodiment described above, determining of the detection feasibility conditions may be performed in any order. In addition, there may be a configuration where, in a case where it is determined that the refrigerant leakage detection driving is not possible based on any one of the conditions, the other detection feasibility conditions are not determined.

(7-6) Modified Example F

In the cooling device management system 100 according to the present embodiment described above, a plurality of the air conditioning devices 10 are controlled by one controller 20 which is disposed at the building 90 as shown in FIG. 1. Here, there may be a configuration where one controller 20 is disposed with regard to one air conditioning device 10 at the building 90 and the one air conditioning device 10 is controlled by the one controller 20.

In addition, in the cooling device management system 100 according to the present embodiment described above, a remote controller which has the same function as the controller 20 may be provided instead of the remote controller 12*c* which is provided for each of the indoor units 12.

What is claimed is:

1. A cooling device management system, connected to a cooling device configured to carry out a refrigerant leakage detection mode to detect leaks of refrigerant in a refrigerant circuit to outside the refrigerant circuit, the cooling management system comprising:

a transmission section configured to transmit instructions to the cooling device;

a reception section configured to receive information from the cooling device;

a refrigerant leakage detection schedule setting section configured to receive inputting of settings of a refrigerant leakage detection schedule in order to carry out the refrigerant leakage detection mode in the cooling device;

a schedule executing section configured to transmit an instruction to carry out the refrigerant leakage detection mode from the transmission section to the cooling device based on the refrigerant leakage detection schedule which is received using the refrigerant leakage detection schedule setting section;

a detection feasibility determining section configured to determine a feasibility of carrying out the refrigerant leakage detection mode based on information about a state of the cooling device received by the reception section when the instruction to carry out the refrigerant leakage detection mode is transmitted by the schedule executing section; and a display section configured to output a leakage determination result of the refrigerant leakage detection mode based on the information received from the cooling device, the detection feasibility determining section being configured to determine whether carrying out the refrigerant leakage detection mode is possible based on a result of determining whether a communication abnormality exists, determining a refrigerant filling state, and determining whether the cooling device is being driven normally, the schedule executing section being configured not to transmit the instruction to carry out the refrigerant leakage detection mode if the detection feasibility determining section determines that the refrigerant leakage detection mode is not possible in the cooling device, the display section displaying a feasibility determination result of the determining whether carrying out the refrigerant leakage detection mode is possible.

2. The cooling device management system according to claim 1, further comprising:

a controller configured to control the cooling device, the controller being arranged in a vicinity of the cooling device, and a remote monitoring device arranged at a distance from the cooling device, the remote monitoring device being configured to control the cooling device through the controller, the controller having the transmission section, the reception section, the refrigerant leakage detection schedule setting section, the schedule executing section, and the display section.

3. The cooling device management system according to claim 1, wherein the schedule executing section is further configured to transmit instructions to perform a specific display accompanying the leakage determination result of the refrigerant leakage detection mode on the display section, from the transmission section to the cooling device.

4. The cooling device management system according to claim 1, wherein the schedule executing section is further configured to transmit instructions so that an operation inputting section of the cooling device does not receive inputting of specific operations during the refrigerant leakage detection mode from the transmission section to the cooling device.

5. The cooling device management system according to claim 1, wherein the schedule executing section does not transmit the instructions to carry out the refrigerant leakage detection mode when it is determined that the cooling device is in an inappropriate state to carry out the refrigerant leakage detection mode in the cooling device, from state information relating to a state of a unit of the cooling device, and the state information is received by the receiving section.

6. The cooling device management system according to claim 1, further comprising:

a normal schedule setting section configured to receive inputting of settings of a normal schedule, the normal schedule including at least a schedule to start driving and to stop driving of a specific unit of the cooling device, the schedule executing section prioritizing the refrigerant leakage detection schedule over the normal schedule.

7. The cooling device management system according to claim 6, wherein the schedule executing section is further configured to restart driving of the cooling device based on the normal schedule after the refrigerant leakage detection mode is completed in the cooling device in a case where driving of the cooling device based on the normal schedule is cancelled in order to carry out the refrigerant leakage detection mode based on the refrigerant leakage detection schedule in the cooling device.

8. The cooling device management system according to claim 1, wherein an R32 refrigerant flows in the refrigerant circuit of the cooling device.

9. The cooling device management system according to claim 2, wherein the schedule executing section is further configured to transmit instructions to perform a specific display accompanying the leakage determination result of the refrigerant leakage detection mode on the display section, from the transmission section to the cooling device.

10. The cooling device management system according to claim 2, wherein the schedule executing section is further configured to transmit instructions so that an operation inputting section of the cooling device does not receive inputting of specific operations during the refrigerant leakage detection mode, from the transmission section to the cooling device.

11. The cooling device management system according to claim 2, wherein the schedule executing section does not transmit the instructions to carry out the refrigerant leakage detection mode when it is determined that the cooling device is in an inappropriate state to carry out the refrigerant leakage detection mode in the cooling device, from state information relating to a state of a unit of the cooling device, and the state information is received by the receiving section.

12. The cooling device management system according to claim 2, further comprising:

a normal schedule setting section configured to receive inputting of settings of a normal schedule, the normal schedule including at least a schedule to start driving and to stop driving of a specific unit of the cooling device, the schedule executing section prioritizing the refrigerant leakage detection schedule over the normal schedule.

13. The cooling device management system according to claim 3, wherein the schedule executing section is further configured to transmit instructions so that an operation inputting section of the cooling device does not receive inputting of specific operations during the refrigerant leakage detection mode, from the transmission section to the cooling device.

14. The cooling device management system according to claim 3, wherein the schedule executing section does not transmit the instructions to carry out the co refrigerant leakage detection mode when it is determined that the cooling device is in an inappropriate state to carry out the refrigerant leakage detection mode in the cooling device, from state information relating to a state of a unit of the cooling device, and the state information is received by the receiving section.

15. The cooling device management system according to claim 3, further comprising:

a normal schedule setting section configured to receive inputting of settings of a normal schedule, the normal schedule including at least a schedule to start driving and to stop driving of a specific unit of the cooling device, the schedule executing section prioritizing the refrigerant leakage detection schedule over the normal schedule.

16. The cooling device management system according to claim 4, wherein the schedule executing section does not transmit the instructions to carry out the refrigerant leakage detection mode when it is determined that the cooling device is in an inappropriate state to carry out the refrigerant leakage detection mode in the cooling device, from state information relating to a state of a unit of the cooling device, and the state information is received by the receiving section.

17. The cooling device management system according to claim 4, further comprising:

a normal schedule setting section configured to receive inputting of settings of a normal schedule, the normal schedule including at least a schedule to start driving and to stop driving of a specific unit of the cooling device, the schedule executing section prioritizing the refrigerant leakage detection schedule over the normal schedule.

18. The cooling device management system according to claim 5, further comprising:

a normal schedule setting section configured to receive inputting of settings of a normal schedule, the normal schedule including at least a schedule to start driving and to stop driving of a specific unit of the cooling device, the schedule executing section prioritizing the refrigerant leakage detection schedule over the normal schedule.

* * * * *